United States Patent [19]

Ono et al.

[11] Patent Number: 4,983,506

[45] Date of Patent: Jan. 8, 1991

[54] SILVER HALIDE PHOTOGRAPHIC MATERIAL

[75] Inventors: Shigetoshi Ono; Hirokazu Kondo; Yoshisada Nakamura, all of Kanagawa, Japan

[73] Assignee: Fuji Photo Film Co., Ltd., Kanagawa, Japan

[21] Appl. No.: 257,665

[22] Filed: Oct. 14, 1988

[30] Foreign Application Priority Data

Oct. 14, 1987 [JP] Japan ..... 62-258696
Feb. 5, 1988 [JP] Japan ..... 63-25483

[51] Int. Cl.[5] ..... G03C 7/26; G03C 7/32; G03C 1/06

[52] U.S. Cl. ..... 430/531; 430/214; 430/215; 430/545; 430/551; 430/627; 430/628

[58] Field of Search ..... 430/214, 531, 551, 545, 430/627, 628, 215, 216, 217

[56] References Cited

U.S. PATENT DOCUMENTS

| | | | |
|---|---|---|---|
| 2,284,877 | 6/1942 | Martinez | 430/545 |
| 2,710,801 | 6/1955 | Minsk et al. | 430/551 |
| 2,735,765 | 2/1956 | Loria et al. | 430/551 |
| 3,700,455 | 10/1972 | Ishikawa et al. | 430/551 |
| 4,178,184 | 12/1979 | Taguchi et al. | 430/551 |
| 4,286,042 | 8/1981 | Sakai et al. | 430/551 |
| 4,477,560 | 10/1984 | Koitabashi et al. | 430/551 |
| 4,724,197 | 2/1988 | Matejec et al. | 430/627 |
| 4,782,011 | 11/1988 | Goddard et al. | 430/551 |

*Primary Examiner*—Richard L. Schilling
*Attorney, Agent, or Firm*—Sughrue, Mion, Zinn, Macpeak & Seas

[57] ABSTRACT

A silver halide photographic material is described, containing at least one polymer, which functions as both a color fogging preventing agent and a color mixing preventing agent, obtained by polycondensation of at least one compound represented by formula (I) and at least one compound represented by formula (II):

(I)

(II)

wherein

G represents hydroxyl group, a group capable of forming hydroxyl group by alkali hydrolysis, a carbonamido group or a sulfonamido group;

n represents an integer of 1 or more, provided that when n is 2 or more, plural G's may be same or different;

$R^1$ and $R^2$ each independently represents hydrogen atom or a substituent; and $R^3$ and $R^4$ each independently represents hydrogen atom, an alkyl group, an aryl group, an aralkyl group, a heterocyclic group, an acyl group, a carboxyl group, or a formyl group, in the presence of an acid or alkali catalyst.

6 Claims, No Drawings

SILVER HALIDE PHOTOGRAPHIC MATERIAL

FIELD OF THE INVENTION

The present invention relates to silver halide photographic materials and, more particularly, to those which are hardly color-stained or color-fogged and which have excellent storage stability.

BACKGROUND OF THE INVENTION

A method of forming color images by exposing silver halide color photographic materials followed by processing the exposed materials with a color developer containing an aromatic primary amine developing agent is well known.

In color image-forming methods of this type, it is also well known that the developing agent is often oxidized by the oxygen in air and the resulting oxidation product of the developing agent reacts with a color coupler contained in the non-exposed part or partially exposed part of the photographic material to form a dye causing a color fog in the photographic material.

In conventional color photographic materials having two or more emulsion layers, each containing a color coupler with a different color-sensitivity and a different hue, it is also known that the oxidation product of a developing agent as formed by development in one color-sensitive layer will diffuse to other color-sensitive layers and react with the coupler therein to cause color staining (color mixing) in the processed photographic material.

As one means for preventing the unfavorable color fog and color stain, a method of using a hydroquinone compound has been proposed.

For example, there are known the mono-n-alkylhydroquinones described in U.S. Pat. Nos. 2,360,290, 2,419,613, 2,403,721 and 3,960,570; the mono-branched alkylhydroquinones described in U.S. Pat. No. 3,700,453, JP-A-No. 49-106329, JP-A-No.50-156438 and West German Patent Application (OLS) No. 2,149,789; the dialkyl-substituted hydroquinones described in U.S. Pat. No. 2,728,659, 2,732,300, 3,243,294 and 3,700,453, British Patent No. 752,146, JP-A-No. 50-156438, JP-A-No. 53-9528, JP-A-54-29637 and JP-B-No. 50-21249; and the arylhydroquinones described in U.S. Pat. No. 2,418,613. (The terms "JP-A" and "JP-B" as used herein mean an "unexamined published Japanese patent application" and an "examined Japanese patent publication", respectively.)

These compounds have an effect for preventing color fog and color stain to some degree. However, the effect is small and diinsufficient. Also these compounds form undesirable colored products upon causing the preventative effect.

Under these circumstances, U.S. Pat. No. 4,198,239 has proposed using a hydroquinone derivative, the nucleus of which is substituted by an electron-attractive group such as an acyl group, a nitro group, a cyano group, a formyl group or a halogenated alkyl group. The derivatives demonstrate excellent color stain-preventing activity but have various problems in that these also form a colored product, cause deterioration of the photographic properties of photographic materials during preparation and storage thereof, and fog silver halide emulsions in the photographic materials.

U.S. Pat. No. 4,198,239 has proposed using a hydroquinone derivative substituted by an aliphatic acylamino group, a ureido group or a urethane group. These derivatives were found to have a high color stain-preventing activity to some degree and which also hardly colored the photographic materials containing them. However, the color stain-preventing activity was still found to be insufficient for practical use, and the derivatives were also inadequate for purposes of storage stability since the derivative formed crystals during preparation of the photographic materials.

U.S. Pat. No. 2,701,197 has proposed a hydroquinone derivative substituted by a sulfonic acid group-containing alkyl group, aralkyl group or acylamino group. However, derivatives of this type were found to be defective since they diffused to other photographic layers to which the derivative was not added during preparation or storage of photographic materials and not only lowered the color stain-preventing activity and color fog-preventing activity in the layer to which the derivative was added but also changed the photographic properties of the other layers during preparation and storage of the photographic materials.

JP-A-No. 59-202465 discloses sulfonamide group-substituted hydroquinones, but the color stain-preventing activity of these compounds was found to be insufficient.

JP-A-No. 57-22237 proposes electron-attractive group-containing hydroquinones, for example, carbamoyl group-substituted hydroquinones. However, these compounds were found problematic since these were easily oxidized during preparation or storage of photographic materials thereby causing changes in the photographic properties of the materials and a noticeable coloring degree of the oxidized product.

U.S. Pat. Nos. 3,930,866 and 4,277,558 disclose the method of using hydroquinones.

U.S. Pat. No. 4,277,558 proposes using a combination of hydroquinone and quinone However, it has been found that when the compounds of the present invention are used under such condition, the color stain-preventing activity thereof is rather lowered In addition, British Patent Nos. 558,258, 557,750 (which corresponds to U.S. Pat. No. 2,360,290), 557,802 and 731,301 (which corresponds to U.S. Pat. No. 2,701,197); U.S. Pat. Nos. 2,336,327, 2,403,721 and 3,582,333; West German Patent Application (OLS) No. 2,505,061 (which corresponds to JP-A-No. 50-110337); and JP-B-No. 56-40816 disclose alkylhydroquinones for use as a color stain-preventing agent.

Also in color diffusion transfer photographic materials, it has been known that the materials often have a so-called "color turbidity" phenomenon, like the common color photographic materials. In order to prevent this phenomenon, the above-mentioned hydroquinones are applied to the color diffusion transfer photographic materials. For example, JP-A-No. 58-21249 discloses hydroquinones for use as a color turbidity preventing agent for diffusion transfer photographic materials.

*Research Disclosure,* No. 15162 (1973), page 83, JP-A-No. 55-72158 and JP-A-No. 57-24941 (which corresponds to U.S. Pat. No. 4,366,226) disclose sulfonamidephenols for use as a color turbidity-preventing agent for diffusion transfer photographic materials.

U.S. Pat. Nos. 2,710,801 and 2,816,028, JP-A-No. 57-17949 and JP-A-No. 61-169844 disclose polymers having a hydroquinone skeleton bonded by a covalent bond, for use as a color stain-preventing agent.

JP-A-No. 59-206833 discloses polymers having a sulfonamidephenol skeleton bonded by a covalent bond, for use as a color stain-preventing agent.

In addition, JP-A-No. 58-156933 discloses that pyrogallol derivatives have a high color fog-preventing activity and JP-A-No. 58-17431 discloses that these derivatives have a latent image-fading preventing activity. However, these derivatives were found not to have satisfactory storage stability.

Accordingly, in the manufacture of color photographic materials, a color stain-preventing agent which efficiently prevents color stain in color photographic materials without lowering the photographic sensitivity thereof, which may be added even to photographic materials where the photographic layer is thinned so as to improve the sharpness, which is not deteriorated with respect to the color stain-preventing activity even after stored for a long period of time, and which has an additional function of contributing to the improvement of the light-fastness of the color images formed by color development, has been desired.

SUMMARY OF THE INVENTION

A first object of the present invention is to provide a color photographic material containing a fully satisfactory color stain-preventing agent.

A second object of the present invention is to provide a color photographic material containing a color stain-preventing agent which efficiently removes the oxidation product of a color developing agent or a charge transfer-type black-and-white developing agent.

A third object of the present invention is to provide a color photographic material which is in the form of a thin film and which contains a fully satisfactory color stain-preventing agent.

A fourth object of the present invention is to provide a photographic material whose photographic properties, especially latent image fading resistance, do not change even after long term storage.

A fifth object of the present invention is to provide a photographic material containing a polymeric color stain-preventing agent which may be easily synthesized.

These objects of the present invention are achieved by providing a silver halide photographic material comprising at least one polymer obtained by polycondensation of at least one compound represented by formula (I) and at least one compound represented by formula (II):

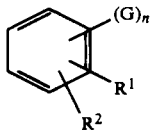

(I)

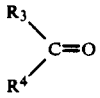

(II)

wherein G represents hydroxyl group, a group capable of forming hydroxyl group by alkali hydrolysis, a carbonamido group or a sulfonamido group;

n represents an integer of 2 or more, provided that plural G's may be same or different;

$R^1$ and $R^2$ (which may be same or different, i.e., $R^1$ and $R^2$ are independently selected) each represents hydrogen atom or a substituent; and $R^3$ and $R^4$ each independently represents hydrogen atom, an alkyl group, an aryl group, an aralkyl group, a heterocyclic group, an acyl group, a carboxyl group, or a formyl group, in the presence of an acid or alkali catalyst.

DETAILED DESCRIPTION OF THE INVENTION

The compounds represented by formulae (I) and (II) will now be explained in detail.

$R^1$ and $R^2$ each independently represents hydrogen atom or a substituent, for example, a halogen atom, cyano group, sulfo group, carboxyl group, or a substituted or unsubstituted alkyl, aryl, aralkyl, acyloxy, acylamino, amino, sulfonamido, alkoxy, aryloxy, alkylthio, arylthio, carbamoyl, sulfamoyl, alkoxycarbonyl, aryloxycarbonyl, alkylsulfonyl, arylsulfonyl, alkoxysulfonyl, aryloxysulfonyl, carbamoylamino, sulfamoylamino, carbamoyloxy, alkoxycarbonylamino or aryloxycarbonylamino group, further provided that when $R^1$ and $R^2$ are adjacent to each other, these may be condensed together to form a carbon ring or a hetero ring.

The alkyl group represented by $R^3$ and $R^4$ may be linear, branched or cyclic. Examples of the alkyl group for $R^3$ and $R^4$ include methyl group, ethyl group, n-propyl group, isopropyl group, n-butyl group, isobutyl group, n-hexyl group, cyclohexyl group, n-heptyl group, n-undecyl group, and n-pentadecyl group. Examples of the aryl group for $R^3$ and $R^4$ include phenyl and naphthyl groups. Examples of the aralkyl group for $R^3$ and $R^4$ include benzyl and phenethyl groups. Examples of the heterocyclic group for $R^3$ and $R^4$ include oxygen-containing rings, nitrogen containing rings, sulfur-containing rings, oxygen and nitrogen-containing rings, and sulfur and nitrogen-containing rings.

As substituents for $R^1$ to $R^4$, there may be mentioned, for example, a halogen atom, nitro group, cyano group, an alkyl group, a substituted alkyl group, an alkoxy group, a substituted alkoxy group, an $-NHCOR^9$ group (where $R^9$ represents an alkyl group, a substituted alkyl group, phenyl group, a substituted phenyl group, an aralkyl group or a substituted aralkyl group), a —CHO group, an $-NHSO_2R^9$ group (where $R^9$ has the same meaning as above), an $-SOR^9$ group (where $R^9$ has the same meaning as above), an $-SO_2R^9$ group (where $R^9$ has the same meaning as above), a $-COR^9$ group (where $R^9$ has the same meaning as above), a

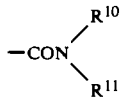

group (where $R^{10}$ and $R^{11}$ may be same or different and each represents hydrogen atom, an alkyl group, a substituted alkyl group, phenyl group, a substituted phenyl group, an aralkyl group or a substituted aralkyl group), an

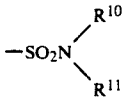

group (where $R^{10}$ and $R^{11}$ have the same meanings as above), an amino group (which may optionally be substituted by one or more alkyl groups), hydroxyl group, and a group capable of forming hydroxyl group by hydrolysis.

As examples of the substituents for the above-mentioned substituted alkyl group, substituted alkoxy group, substituted phenyl group and substituted aralkyl group, there may be mentioned hydroxyl group, nitro group, an alkoxy group having from 1 to about 4 carbon atoms, an $-NHSO_2R^9$ group (where $R^9$ has the same meaning as above), an

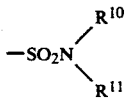

(where $R^{10}$ and $R^{11}$ have the same meanings as above) a

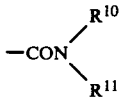

(where $R^{10}$ and $R^{11}$ have the same meanings as above), an $-SO_2R^9$ group (where $R^9$ has the same meaning as above), a $-COR^9$ group (where $R^9$ has the same meaning as above), a halogen atom, cyano group, and an amino group (which may optionally be substituted by one or more alkyl groups).

G represents hydroxyl group, a group capable of forming hydroxyl group by hydrolysis, a carbonamido group or a sulfonamido group. Examples of the group capable of forming hydroxyl group by hydrolysis include an acyl group (e.g., acetyl, benzoyl), a hydroxycarbonyl group (e.g., ethoxycarbonyl, benzyloxycarbonyl, tertbutyloxycarbonyl, phenoxycarbonyl), a carbamoyl group (e.g., N,N-dimethylcarbamoyl, N,N-diethylcarbamoyl), a sulfonyl group (e.g., methanesulfonyl, benzenesulfonyl), 3-ketobutyl group, a substituted aminomethyl group (e.g., N,N-dimethylaminomethyl 1,5-diketopyrrolidylmethyl), and phthalide group.

The carbonamido group for G is represented by $-NHCOR^7$ (where $R^7$ represents a substituted or unsubstituted alkyl, aryl or aralkyl group); and the sulfonamido group for G is represented by $-NHSO_2R^7$ (where $R^7$ has the same meaning as above).

In formula (I), preferred groups represented by $R^1$ and $R^2$ include hydrogen atom, sulfo group, carboxyl group, a substituted or unsubstituted alkyl group having from 1 to 18 carbon atoms, a substituted or unsubstituted alkoxy group having from 1 to 18 carbon atoms, an amino group substituted by substituted or unsubstituted alkyl group(s) having from 1 to 18 carbon atoms or substituted or unsubstituted phenyl group(s) having from 6 to 24 carbon atoms (where the alkyl substituents may be bonded to form a condensed ring optionally together with hetero atom(s),), a substituted or unsubstituted phenyl group having from 6 to 24 carbon atoms, a carbamoyl or sulfamoyl group substituted by substituted or unsubstituted alkyl group(s) having from 1 to 18 carbon atoms or substituted or unsubstituted phenyl group(s) having from 6 to 24 carbon atoms (where the alkyl substituents may be bonded to form a condensed ring optionally together with hetero atom(s)), a substituted or unsubtituted alkyl-sulfonamide or -acylamino group having from 1 to 18 carbon atoms, a substituted or unsubstituted phenyl-sulfonamide or -acylamino group having from 6 to 24 carbon atoms, a substituted or uhsubstituted alkylsulfonyl group having from 1 to 18 carbon atoms, a substituted or unsubstituted phenylsulfonyl group having from 6 to 24 carbon atoms, a substituted or unsubstituted alkoxycarbonyl group having from 2 to 18 carbon atoms, or a substituted or unsubstituted aryloxycarbonyl group having from 7 to 25 carbon atoms. G preferably represents hydroxyl group, a carbonamide group or a sulfonamide group; and n preferably represents 1 or 2.

Preferably, $R^3$ and $R^4$ each represents hydrogen atom, a substituted or unsubstituted alkyl group having from 1 to 18 carbon atoms, a substituted or unsubstituted aralkyl group having from 7 to 25 carbon atoms, a substituted or unsubstituted phenyl group having from 6 to 24 carbon atoms, or a substituted or unsubstituted pyridine or furan ring.

In the formula (I), most preferably, $R^1$ and $R^2$ each represents hydrogen atom, sulfo group, carboxyl group, a substituted or unsubstituted alkali group having from 1 to 12 carbon atoms, a substituted or unsubstituted alkoxy group having from 1 to 12 carbon atoms, an amino group substituted by substituted or unsubstituted alkyl group(s) having from 1 to 6 carbon atoms or substituted or unsubstituted phenyl group(s) having from 6 to 12 carbon atoms (where the alkyl substituents may be bonded to form a condensed ring optionally together with hetero atom(s)), a substituted or unsubstituted phenyl group having from 6 to 12 carbon atoms, a carbamoyl or sulfamoyl group substituted by substituted or unsubstituted alkyl group(s) having from 1 to 6 carbon atoms or substituted or unsubstituted phenyl group(s) having from 6 to 12 carbon atoms (where the alkyl substituents may be bonded to form a condensed ring optionally together with hetero atom(s)), an acylamino group having from 1 to 13 carbon atoms, a substituted or unsubstituted alkylsulfonyl group having from 1 to 3 carbon atoms, a substituted or unsubstituted phenylsulfonyl group having from 6 to 12 carbon atoms, a substituted or unsubstituted alkoxycarbonyl group having from 2 to 12 carbon atoms, or a substituted or unsubstituted aryloxycarbonyl group having from 7 to 19 carbon atoms; G represents hydroxyl group or a sulfonamido group; and n represents 2 or 3.

In formula (II), $R^3$ and $R^4$ are each more preferably hydrogen atom or a substituted or unsubstituted alkyl group having from 1 to 12 carbon atoms.

Among the compounds represented by above-mentioned formula (I), those represented by the following formulae (III), (IV), (V) and (VI) are preferred. The compounds represented by formulae (V) and (VI) are most preferred.

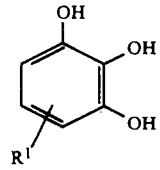

(III)

-continued
(IV)
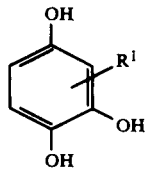
(V)
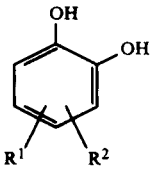
(VI)
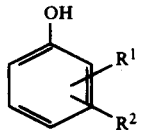
In formulae (III), (IV), (V) and (VI), $R^1$ and $R^2$ have the same meanings as mentioned above, respectively.
Specific examples of the compounds of the formulae (I) and (II) are mentioned below; however, the scope of the present invention is not restricted to these compounds.
I-1
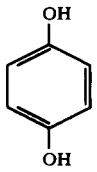
I-2
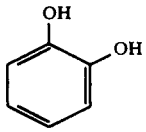
I-3
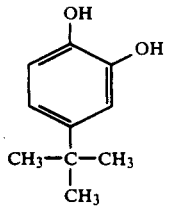
I-4
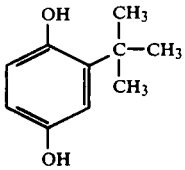
I-5
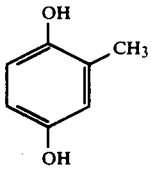
-continued
I-6
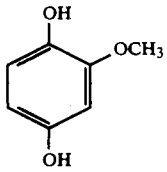
I-7
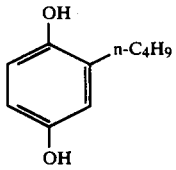
I-8
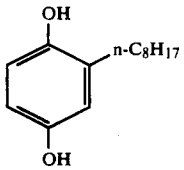
I-9
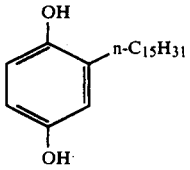
I-10
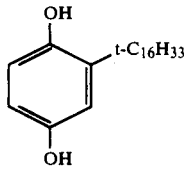
I-11
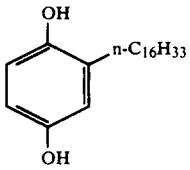
I-12
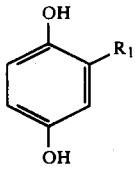
($R_1$ is a mixed alkyl group having from 10 to 18 carbon atoms.)
I-13
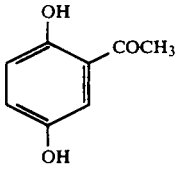
I-14
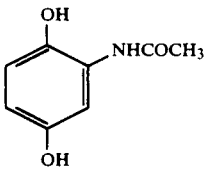

-continued
I-15
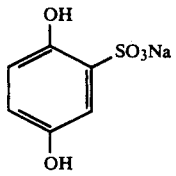
I-16
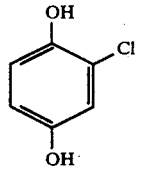
I-17
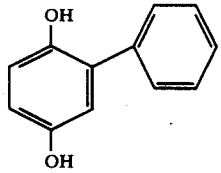
I-18
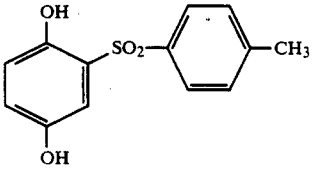
I-19
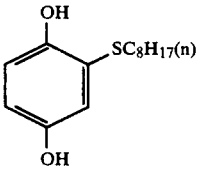
I-20
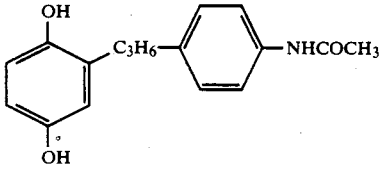
I-21
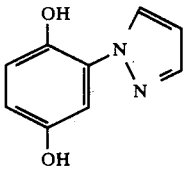
I-22
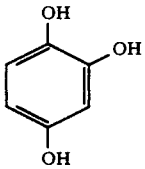
I-23
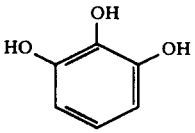
-continued
I-24
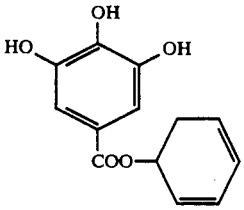
I-25
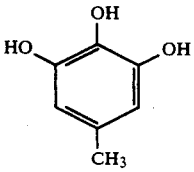
I-26
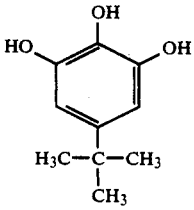
I-27
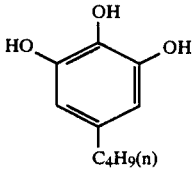
I-28
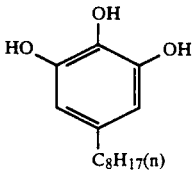
I-29
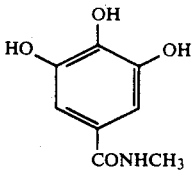
I-30
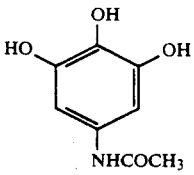
I-31
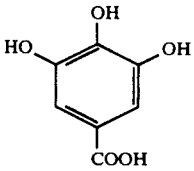

-continued
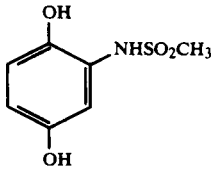
I-32
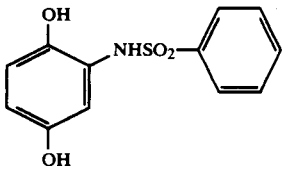
I-33
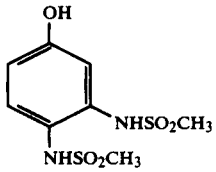
I-34
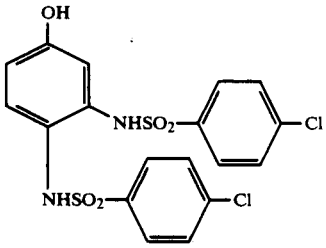
I-35
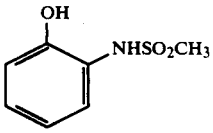
I-36
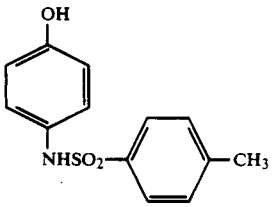
I-37
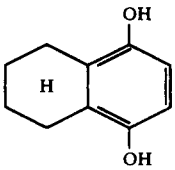
I-38
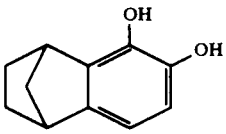
I-39
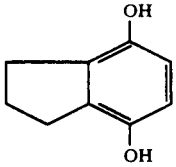
I-40
-continued
| | |
|---|---|
| HCHO | II-1 |
| $CH_3CHO$ | II-2 |
| $CH_3OCH_2CHO$ | II-3 |
| n-$C_3H_7CHO$ | II-4 |
| n-$C_7H_{15}CHO$ | II-5 |
| n-$C_{11}H_{23}CHO$ | II-6 |
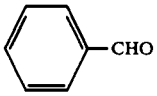
II-7
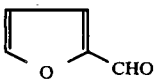
II-8
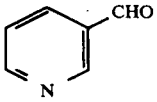
II-9
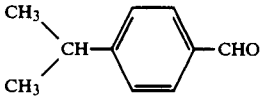
II-10
$CH_3COCHO$ II-11
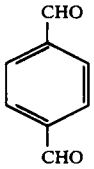
II-12
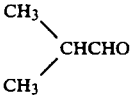
II-13
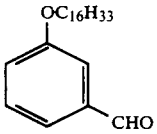
II-14
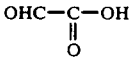
II-15
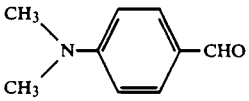
II-16
OHC—CHO II-17
Paraformaldehyde II-18
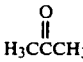
II-19
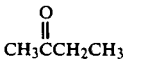
II-20
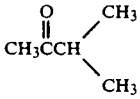
II-21

-continued

II-22 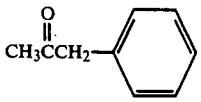

II-23 $CH_3\overset{O}{\overset{\|}{C}}C_6H_{13}(n)$

II-24 $C_2H_5\overset{O}{\overset{\|}{C}}C_2H_5$

II-25 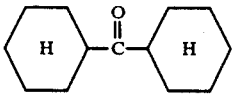

II-26 $C_3H_6\overset{O}{\overset{\|}{C}}C_3H_6$

II-27 $CH_3\overset{O}{\overset{\|}{C}}CH_2CH_2OH$

II-28 $CH_3\overset{O}{\overset{\|}{C}}CH_2CH_2N(CH_2CH_3)_2$

II-29 $(CH_3)_2CH\overset{O}{\overset{\|}{C}}CH(CH_3)_2$

II-30 $ClCH_2\overset{O}{\overset{\|}{C}}CH_2Cl$

II-31 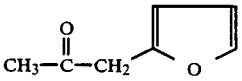

For preparation of the polymers for use in the present invention, at least one compound of formula (I) and at least one compound of formula (II) may be reacted for polycondensation.

In order to change the properties of the resulting polymer (solubility, molecular weight), any desired compounds may be added during or after polymerization. Examples include various kinds of solvents, acids (inorganic and organic acids), bases (inorganic and organic bases), phenols, salts (inorganic and organic salts), epichlorohydrin, melamine, lignin, chroman, indene, xylene, thiophene, polyamide compounds, aliphatic acid amides, polyvinyl alcohols, polyvinyl compounds, esters, acid halides, halogenated alkyls and carboxylic acids. This list is merely illustrative and not exhaustive of the additives encompassed by the present invention.

The polymers for use in the present invention can be produced in accordance with the method described in S. Murayama, *Phenol Resins* (1981).

In the polymers for use in the photographic materials of the present invention, the content of the compound of the formula (I) is preferably from 10 to 95% by weight of the polymer.

When the polymeric color stain-preventing agents for use in the present invention contain a long chain alkyl moiety (having 6 or more carbon atoms) in the molecule of the polymer, the polymer is preferred to have a mean molecular weight of from 200 to 10,000 (more preferably from 1,000 to 8,000). When, on the other hand, the polymers do not contain a long chain alkyl moiety in the molecule, the polymer is preferred to have a mean molecular weight of 500 or more (more preferably from 2,000 to 20,000).

The molecular weight in the polymers may be controlled by adjusting the amount of the catalyst to be used, the reaction temperature and time, and the ratio of compound(s) (I) to compound(s) (II).

A long chain alkyl moiety may be introduced into the polymer by polymeric reaction.

Next, some examples of production of the compounds and polymers for use in the present invention will be mentioned below.

PRODUCTION EXAMPLE 1

Production of Polymer No. 1 of the Invention 50 ml of ethanol were added to 22 g (0.2 mol) of a commercial catechol and 17 g (0.2 mol) of a commercial 35% formalin and stirred with maintaining a temperature of 90° C.

3 ml of 1N hydrochloric acid was added as a catalyst and the resulting solution was reacted for 8 hours. After the reaction, the unreacted catechol and formalin were removed from the reaction mixture by steam distillation, and the remaining resin was dissolved in 30 ml of methanol and reprecipitated in 300 ml of water for purification. After drying, 18 g of the intended product (having a mean molecular weight of 1500) was obtained.

PRODUCTION EXAMPLE 2

Production of Polymer No. 2 of the Invention 12.6 g (0.1 mol per unit) of the polymer of the invention obtained in Production Example 1 and 2.5 g (0.025 mol) of triethylamine were dissolved in 100 ml of YHF, and 6.9 g (0.025 mol) of palmitoyl chloride was added dropwise thereto while maintaining a temperature of 10° C. or lower by ice-cooling. After the addition, the resulting solution was reacted at room temperature for 3 hours, and the reaction solution was then added to 500 ml of water with stirring. This was washed three times with 200 ml of water and then dried under reduced pressure to obtain 16.5 g of the intended product (polymer No. 2).

PRODUCTION EXAMPLE 3

In the same manner as above, the following polymer Nos. 3 to 23 for use in the present invention were prepared as shown in Table 1.

TABLE 1

| Polymers of the Invention | Chemical Reagents as Reacted (I) | (II) | (a)** | Chemical Reagents for Post-treatment (b) | Weight Ratio, wt (%) (I)/(II)/(a)/(b) |
|---|---|---|---|---|---|
| 3 | 1 | 1 | 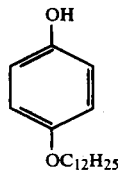 | — | 47/13/40/— |
| 4 | 1 | 1 | — | $C_{15}H_{31}COCl$ | 50/13/—/37 |
| 5 | 1 | 5 | — | — | 46/54/—/— |
| 6 | 1 | 1/6* | — | — | 50/50/—/— |
| 7 | 2 | 1 | 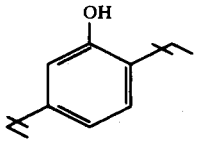 | — | 51/14/35/— |
| 8 | 3 | 1/6* | — | — | 56/44/—/— |
| 9 | 8 | 4 | — | — | 75/25/—/— |
| 10 | 9 | 1 | — | — | 90/10/—/— |
| 11 | 9 | 1 | 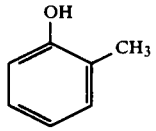 | — | 80/9/11/— |
| 12 | 32 | 2 | — | — | 66/34/—/— |
| 13 | 8 | 5 | — | — | 63/37/—/— |
| 14 | 8 | 7 | — | — | 68/32/—/— |
| 15 | 8 | 8 | — | — | 70/30/—/— |
| 16 | 8 | 12 | — | — | 77/23/—/— |
| 17 | 8 | 18 | — | — | 85/15/—/— |
| 18 | 16 | 13 | — | $C_{17}H_{35}COCl$ | 46/23/—/31 |
| 19 | 19 | 1 | — | — | 82/18/—/— |
| 20 | 22 | 1 | — | $C_{17}H_{35}COCl$ | 50/12/—/38 |
| 21 | 22 | 1 | 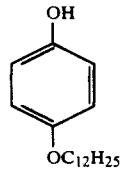 | — | 50/13/37 |
| 22 | 23 | 1 | " | — | 53/14/33 |
| 23 | 34 | 1 | — | — | 60/13/37 |

*same molar ratio
**additive other than (I) and (II)

PRODUCTION EXAMPLE 4

Production of Polymer No. 24 of the Invention 10 g (80 mmols) of a commercial pyrogallol and 30 g (0.5 mol) of acetone were stirred at room temperature and 1.2 g (8 mmols) of phosphorus oxychloride was added thereto as a catalyst. Then the resulting solution was heated to reflux the acetone and was allowed to react for 8 hours. 50 g of acetone was further added and the reaction mixture was cooled to room temperature. After cooling, the reaction solution was reprecipitated in 500 ml of water, and the resulting precipitate was fractionated and dried to obtain 12 g of the intended product. The mean molecular weight of the product was 3900.

PRODUCTION EXAMPLE 5

Production of Polymer No. 25 of the Invention

In the same manner as in Production Example 4, except that the amount of phosphorus oxychloride used was 4.8 g (32 mmols), 1.8 g of the intended product was obtained. The mean molecular weight of the product was 9,000.

PRODUCTION EXAMPLE 6

In the same manner as above, the following polymer Nos. 26 to 38 for use in the present invention were prepared as shown in Table 2.

TABLE 2

| Polymers of the Invention | Chemical Reagents as Reacted (I) | (II) | Chemical Reagents for Post-treatment (c) | Molar Ratio of Reagents (Based on 10 mols of Reagent (I)) (I)/(III)/(c) |
|---|---|---|---|---|
| 26 | 23 | 20 | — | 10/63/— |
| 27 | 23 | 21 | — | 10/63/— |
| 28 | 23 | 24 | — | 10/63/— |
| 29 | 23 | 30 | — | 10/63/— |
| 30 | 23 | 19 | $C_{13}H_{27}COCl$ | 10/63/2 |
| 31 | 28 | 19 | — | 10/80/— |
| 32 | 29 | 19 | — | 10/80/— |
| 33 | 22 | 19 | — | 10/63/— |
| 34 | 22 | 20 | — | 10/63/— |
| 35 | 22 | 19 | $C_{17}H_{35}COCl$ | 10/80/4 |
| 36 | 25 | 19 | — | 10/63/— |
| 37 | 25 | 24 | — | 10/80/— |
| 38 | 25 | 19 | $C_{15}H_{31}COCl$ | 10/80/4 |

PRODUCTION EXAMPLE 7

Production of Polymer No. 39 of the Invention 150 ml of ethanol were added to 44 g (0.4 mol) of Compound (I-1), 40.6 g (0.2 mol) of Compound (I-32) and 51 g (0.6 mol) of a commercial formalin and stirred at a temperature of 90° C. 3 ml of a 1N hydrochloric acid was added thereto and stirred for 8 hours. Afterwards, the unreacted Compound (I-1) and formalin were removed from the reaction mixture by steam distillation. After concentration, the reaction mixture was purified using a column containing Sephadex as a carrier and methanol/acetone mixture (4/1, by volume) as a developer solvent, to obtain 43 g of the intended product. The mean molecular weight of the product was 1,100.

PRODUCTION EXAMPLE 8

In the same manner as above, the following Polymers Nos. 40 to 46 for use in the present invention were prepared as shown in Table 3.

TABLE 3

| Polymers of the Invention | Chemical Reagents as Reacted | Molar Ratio of Reagents |
|---|---|---|
| 40 | I-1/I-8/II-1 | 5/1/6 |
| 41 | I-2/I-9/II-1 | 10/1/11 |
| 42 | I-5/I-32/II-1 | 5/5/11 |
| 43 | I-22/I-23/II-19 | 1/1/20 |
| 44 | I-22/II-19/II-20 | 1/10/10 |
| 45 | I-22/II-1/II-19 | 2/1/10 |
| 46 | I-1/I-22/II-1/II-19 | 1/1/1/10 |

The polymer of the present invention can be added to either a silver halide emulsion layer or a non-light-sensitive layer, but is preferably added to a non-light-sensitive layer. The same polymer may be added to two or more different layers, or two or more different polymers may be added to the same layer. The amount of the polymer to be added is from $1\times10^{-6}$ to $1\times10^{-3}$ mol/m$^2$, preferably from $10^{-5}$ to $10^{-3}$ mol/m$^2$, as the unit derived from the formula (I).

The polymer of the present invention is preferably used as a color mixing preventing agent, but may also be used as a color fogging preventing agent in a silver halide emulsion layer. In the latter case, the amount of the polymer to be added is from $1.0\times10^{-7}$ to $1.0\times10^{-4}$ mol/m$^2$, preferably from $1.0\times10^{-6}$ to $1.0\times10^{-4}$ mol/m$^2$, as the unit derived from the formula (I).

The polymer of the present invention and other couplers or dye image-providing compounds which may be used together with the polymer of the present invention and which will be mentioned hereunder may be introduced into photographic materials by various known dispersion methods. As specific examples of the dispersion methods, there may be mentioned a solid dispersion method, an alkali dispersion method, preferably a latex dispersion method, and more preferably an oil-in-water dispersion method. In accordance with an oil-in-water dispersion method, the compound is dissolved in a single solution of either a high boiling point organic solvent having a boiling point of 175° C. or higher, a so-called auxiliary solvent having a low boiling point or in a combined solution comprising the both types of solvents, and the resulting solution is finely dispersed in an aqueous medium such as water or an aqueous gelatin solution in the present of a surfactant. Examples of the high boiling point organic solvent are described in U.S. Pat. No. 2,322,027. The dispersion may be accompanied by phase inversion. If desired, the auxiliary solvent may be removed or reduced by distillation, noddle washing or ultrafiltration before the thus prepared emulsion is coated.

As examples of high boiling point organic solvents which may be used in the process, there may be mentioned phthalic acid esters (e.g., dibutyl phthalate, dicyclohexyl phthalate, di-2-ethylhexyl phthalate, didodecyl phthalate), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate), benzoic acid esters (e.g., 2-ethylhexyl benzoate, dodecyl benzoate, 2-ethylhexyl p-hydroxybenzoate), amides (e.g., diethyldodecanamide, N-tetradecylpyrrolidone), alcohols or phenols (e.g., isostearyl alcohol, 2,4-di-tert-amylphenol), aliphatic carboxylic acid esters (e.g., dioctyl azelate, glycerol tributyrate, isostearyl lactate, trioctyl citrate), aniline derivatives (e.g., N,N-dibutyl-2-butoxy-5-tert-octylaniline), and hydrocarbons (e.g., paraffins, dodecylbenzene, diisopropylnalthalene). As the auxiliary solvent, a solvent having a boiling point of from about 30° C. to about 160° C. can be used, and specific examples thereof include ethyl acetate, butyl acetate, ethyl propionate, methyl ethyl ketone, cyclohexanone, 2-ethoxyethyl acetate and dimethylformamide.

A latex dispersion method may be applied to dispersion of the polymer of the present invention, and the steps and effects thereof, as well as concrete examples of the latex for use in the method, are described in U.S. Pat. No. 4,199,363 and West German Patent Application (OLS) Nos. 2,541,274 and 2,541,230.

The polymers of the present invention can be utilized in coupler-type conventional color photographic materials as well as in ready-made dye-providing compound-using color diffusion transfer photographic materials.

When the compound of the present invention is applied to a color diffusion transfer photographic method, the photographic material may have various kinds of constitutions, such as a peel-part type film unit, or an integrated type film unit (for example, as described in JP-B-No. 46-16356 and JP-B-No. 48-33697, JP-A-No. 50-13040 and British Patent No. 1,330,524) or a nonpeel-apart type film unit (for example, as described in JP-A-No. 57-119345).

In any of these formats, it is advantageous to use a polymeric acid layer as protected by neutralization-timing layer for the purpose of broadening the acceptable range of the processing temperature. When the polymer of the present invention is used in the color diffusion transfer photographic method, this may be added to any layer of the photographic material, or alternatively, this may be put in a processing solution container as one of the developer components.

Any silver halide such as silver bromide, silver iodobromide, silver iodochlorobromide, silver chlorobromide and silver chloride may be used in the photographic emulsion layer in the photographic material of the present invention. Preferably, the silver halide is a silver iodobromide or silver iodochlorobromide containing silver iodide in an amount of about 30 mol % or less. More preferably, the silver halide is a silver iodobromide containing silver iodide in an amount of from about 2 mol % to about 25 mol %.

The silver halide grains in the photographic emulsion may be so-called regular grains having a regular crystal form such as a cubic, octahedral or tetradecahedral crystal form, or irregular grains having an irregular crystal form such as a spherical crystal form, or grains having a crystal defect such as a twin plane, or grains having a composite form of the above-mentioned crystal forms.

Regarding the grain size of the silver halide grains, the grains may be fine grains of about 0.1μ or less or large size grains having a projected area diameter of up to about 10μ. The silver halide emulsion may be either a monodispersed emulsion having a narrow grain size distribution or a polydispersed emulsion having a broad grain size distribution.

The silver halide photographic emulsion for use in the present invention can be prepared in a conventional manner, for example, in accordance with the method described in *Research Disclosure*, RD No. 17643 (December, 1978), pages 22 to 23, "I. Emulsion Preparation and Types" or in ibid., No. 18716 (November, 1979), page 648.

The photographic emulsion for use in the present invention can be prepared by the methods described in P. Glafkides, *Chimie et Physique Photographique* (published by Paul Montel, 1967), G. F. Duffin, *Photographic Emulsion Chemistry* (published by Focal Press, 1966), and V. L. Zelikman et al., *Making and Coating Photographic Emulsion* (published by Focal Press, 1964). For example, the silver halide emulsion may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the existence of excessive silver ions can also be employed. As one system of the double jet method, a so-called controlled double jet method of keeping a constant pAg in a liquid phase of forming silver halide grains can also be employed. According to the method, a silver halide emulsion containing silver halide grains having a regular crystal from and almost uniform grain size can be obtained.

Two or more different kinds of silver halide emulsions separately prepared can be blended together for use in the present invention.

A silver halide emulsion comprising the above-mentioned regular silver halide grains may be obtained by controlling pAg and pH in the formation of the grains. More precisely, the disclosures of *Photographic Science and Engineering*, Vol. 6, pages 159 to 165 (1962), *Journal of Photographic Science*, Vol. 12, pages 242 to 251 (1964), U.S. Pat. No. 3,655,394 and British Patent No. 1,413,748 may be referred to.

As the monodispersed emulsion for use in the present invention, an emulsion containing silver halide grains having a mean grain size diameter larger than about 0.1μ, in which at least about 95% by weight of the grains have a diameter falling within the range of the mean grain size diameter ±40%, is typical More preferably, an emulsion containing silver halide grains having a mean grain size diameter of from about 0.25 to about 2μ, in which at least about 95% by weight or by number of the silver halide grains have a diameter falling within the range of the mean grain size diameter ±20%, may be used in the present invention. The method for preparation of such emulsions is described in U.S. Pat. Nos. 3,574,628 and 3,655,394 and British Patent No. 1,413,748. In addition, the monodispersed emulsions described in JP-A-No. 48-8600, JP-A-No. 51-39027, JP-A-No. 51-83097, JP-A-No. 53-137133, JP-A-No. 54-48521, JP-A-No. 54-99419, JP-A-No. 58-37635 and JP-A-No. 58-49938 may also preferably be used in the present invention.

Further, tabular grains having an aspect ratio of about 5 or more may also be used in the present invention. Tabular grains may easily be prepared by the methods described in Gutoff, *Photographic Science and Engineering*, Vol. 14, pages 248 to 257 (1970), U.S. Pat. Nos. 4,434,226, 4,414,310, 4,433,048 and 4,439,520 and British Patent No. 2,112,157. The use of tabular grains is advantageous for improvement of the color sensitization efficiency with sensitizing dyes, improvement of the graininess of photographic materials and elevation of the sharpness thereof, which is described in detail in the aforesaid U.S. Pat. No. 4,434,226.

The crystal structure of the silver halide grains for use in the present invention may be uniform in the outer and inner parts thereof, or the outer part and the inner parts of the grains may have different halogen compositions, or the two parts may form a stratiform structure. The emulsion grains of these types are illustrated in British Patent No. 1,027,146, U.S. Pat. Nos. 3,505,068 and 4,444,877 and JP-A-No. 60-143331. Further, the grains may have different silver halide compositions as bonded by epitaxial junction, or they may also have compounds other than silver halides, such as silver rhodanide or lead oxide, bonded to the grains. The emulsion grains of these types are illustrated in U.S. Pat. Nos. 4,094,684, 4,142,900 and 4,459,353, British Patent No. 2,038,792, U.S. Pat. Nos. 4,349,622, 4,395,478, 4,433,501, 4,463,087, 3,656,962 and 3,852,067 and JP-A-No. 59-162540.

In addition, a mixture comprising grains of different crystal forms may also be used in the present invention.

The emulsions for use in the present invention are generally physically ripened, chemically ripened and spectrally sensitized before use Additives to be used in the steps are described in *Research Disclosure*, Nos. 17643 and 18716, and the relevant parts are mentioned in Table 4.

Other known photographic additives which may be used in the present invention are also described in the two above-mentioned *Research Disclosure's*, and the relevant parts are also mentioned in Table 4.

TABLE 4

| Kinds of additive | RD 17643 | RD 18716 |
|---|---|---|
| 1. Chemical Sensitizer | p. 23 | p. 648, right column |
| 2. Sensitivity-enhancer | | p. 648, right column |
| 3. Spectral Sensitizer Super Color Sensitizer | pp. 23–24 | from p, 648, right column to p. 649, right column |
| 4. Brightening Agent | p. 24 | |
| 5. Anti-foggant Stabilizer | pp. 24–25 | p. 649, right column |
| 6. Light Absorbent Filter Dye UV Absorbent | pp. 25–26 | from p. 649, right column to P. 650, left column |
| 7. Stain Inhibitor | p. 25, right column | P. 650, from left to right column |
| 8. Color image Stabilizer | p. 25 | |
| 9. Hardening Agent | p. 26 | P. 651, left column |
| 10. Binder | p. 26 | P. 651, left column |
| 11. Plasticizer Lubricant | p. 27 | P. 650, right column |
| 12. Coating Aid Surfactant | pp. 26–27 | P. 650, right column |
| 13. Antistatic Agent | P. 27 | P. 650, right column |

Various kinds of color couplers can be used in the present invention, and examples of color couplers which may be used in the present invention are described in the patent publications as referred to in the aforesaid *Research Disclosure*, RD No. 17643, VII-C to D. As the dye-forming couplers, those capable of giving three primary colors in subtractive color process (that is, yellow, magenta and cyan) by color development are important. Examples of non-diffusible, 4-equivalent or 2-equivalent couplers are disclosed in the patent publications as referred to in the aforesaid RD No. 17643, VII-C to D, which may be used in the present invention. In addition, the following couplers are preferably used in the present invention.

As the typical yellow couplers for use in the present invention, there are hydrophobic ballast group-containing acylacetamide couplers. Specific examples thereof are described in U.S. Pat. Nos. 2,407,210, 2,875,057 and 3,265,506. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501 and 4,022,620, and the nitrogen atom-releasing type yellow couplers described in JP-B-No. 58-10739, U.S. Pat. Nos. 4,401,752 and 4,326,024, RD No. 18053 (April, 1979), British Patent No. 1,425,020, West German Patent Application (OLS) Nos. 2,219,917, 2,261,361, 2,329,587 and 2,433,812. In these yellow couplers, α-pivaloylacetanilide couplers are excellent in fastness, in particular, light fastness of colored dyes formed, while α-benzoylacetanilide couplers are excellent in coloring density.

As the magenta couplers for use in the present invention, there are hydrophobic ballast group-containing indazolone or cyanoacetyl couplers, preferably 5-pyrazolone or pyrazoloazole couplers. As the 5-pyrazolone couplers, those substituted by an arylamino or acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896 and 3,936,015. Also, as the split-off groups for the 2-equivalent 5-pyrazolone couplers, the nitrogen atom-releasing groups described in U.S. Pat. No. 4,310,619 and the arylthio groups described in U.S. Pat. No. 4,351,897 are preferred. Furthermore, the 5-pyrazolone magenta couplers having a ballast group described in European Patent No. 73,636 give high coloring density. As the pyrazoloazole couplers, there may be mentioned the pyrazolobenzimidazoles described in U.S. Pat. No. 3,369,879, preferably the pyrazolo[5,1-c][1,2,4]triazoles described in U.S. Pat. No. 3,725,067 the pyrazolotetrazoles described in *Research Disclosure*, RD No. 24220 (June, 1984) and JP-A-No. 60-33552 and the pyrazolopyrazoles described in *Research Disclosure*, RD No. 24230 (June, 1984) and JP-A-No. 60-43659. The imidazo[1,2-b]pyrazoles described in U.S. Pat. No. 4,500,630 are preferred because of the small yellow side-absorption of the colored dye and of the sufficient light-fastness thereof, and in particular, the pyrazolo[1,5-b][1,2,4]triazole described in European Patent No. 119,860A is especially preferred.

As the cyan couplers for use in the present invention, there are hydrophobic and non-diffusible naphthol and phenol couplers. There are the naphthol couplers described in U.S. Pat. No. 2,474,293, preferably the oxygen atom-releasing 2-equivalent naphthol couplers described in U.S. Pat. Nos. 4,052,212, 4,146,396, 4,228,233 and 4,296,200, as the typical examples Specific examples of phenol couplers which may be used in the present invention are described in U.S. Pat. Nos. 2,369,929, 2,801,171, 2,772,162 and 2,895,826. Cyan couplers having high fastness to humidity and temperature are preferably used in the present invention and specific examples of these cyan couplers include the phenol cyan couplers having an alkyl group of 2 or more carbon atoms at the meta-position of the phenol nucleus described in U.S. Pat. No. 3,772,002; the 2,5-diacylamino-substituted phenol cyan couplers described in U.S. Pat. Nos. 2,772,162, 3,758,308, 4,126,396, 4,334,011 and 4,327,173, West German Patent Application (OLS) No. 3,329,729 and European Patent No. 121,365; and the phenol cyan couplers having a phenylureide group at the 2-position thereof and an acylamino group at the 5-position thereof described in U.S. Pat. Nos. 3,446,622, 4,333,999, 4,451,559 and 4,427,767.

In order to correct the unnecessary absorption of the color dyes formed, colored couplers are preferably used in picture-taking color photographic materials, for the purpose of masking. As specific examples of colored couplers to be used, there are the yellow-colored magenta couplers described in U.S. Pat. No. 4,163,670 and JP-B-No. 57-39413, and the magenta-colored cyan couplers described in U.S. Pat. Nos. 4,004,929 and 4,138,258 and British Patent No. 1,146,368. Other colored couplers which may be used for the purpose are described in the aforesaid RD 17643, VII-G.

In the present invention, by using couplers giving colored dyes having a proper diffusibility together with the aforesaid color couplers, the graininess of color images formed can be improved. Specific examples of magenta couplers of this type are described in U.S. Pat. No. 4,366,237 and British Patent No. 2,125,570 and specific examples of yellow, magenta and cyan couplers of this type are described in European Patent No.

96,570 and West German Patent Application (OLS) No. 3,234,533.

The dye-forming couplers and the above-mentioned specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Patent No. 2,102,173 and U.S. Pat. No. 4,367,282.

Couplers capable of releasing a photographically useful group along the coupling may also preferably be used in the present invention. As DIR couplers capable of releasing a development inhibitor, the couplers described in the patent publications as referred to in the aforesaid RD 17643, VII-F are useful for the present invention.

DIR couplers which are more preferred include developer-deactivating type DIR couplers such as those described in JP-A-No. 57-151944, timing-type DIR couplers such as those described in U.S. Pat. No. 4,248,962 and JP-A-No. 57-154234, and the reactive type DIR couplers, such as those described in JP-A-No. 60-184248. In particular, the developer-deactivating type DIR couplers described in JP-A-No. 57-151944, JP-A-No. 58-217932, JP-A-No. 60-218644, JP-A-No. 60-225156 and JP-A-No. 60-233650, and the reactive type DIR couplers described in JP-A-No. 60-184248 are most preferred.

The photographic material of the present invention can contain a coupler which may imagewise release a nucleating agent or a development accelerator or a precursor thereof in development. Examples of such compounds are described in U.S. Pat. Nos. 2,097,140 and 2,131,188. Couplers capable of releasing a nucleating agent which has an adsorbing action to silver halides are especially preferred, and examples of such couplers are described in JP-A-No. 59-157638 and JP-A-No. 59-170840.

Supports which are suitably used in the present invention are described, for example, in the aforesaid RD No. 17643, page 28 and RD No. 18716, from page 647, right-hand column to page 648, left-hand column.

The color photographic materials of the present invention can be developed by conventional methods, for example, in accordance with the methods described in the aforesaid RD No. 17643, pages 28 to 29 and RD No. 18716, page 651, from left-hand to right-hand column.

The color photographic materials of the present invention are, after developed and bleach-fixed or fixed, generally rinsed with water or stabilized.

In the rinsing step, two or more rinsing tanks are generally used in a countercurrent system, so as to economize the rinsing water to be used. Stabilization may be effected in place of rinsing in water, and one typical example is the multi-stage countercurrent stabilization system described in JP-A-No. 57-8543. In this system, from 2 to 9 countercurrent baths are required. Various kinds of compounds are added to the stabilization bath for the purpose of stabilizing the images formed. For instance, there may be mentioned various kinds of buffers for adjusting the film pH (for example, in the range of from pH 3 to pH 8), such as borates, metaborates, borax, phosphates, carbonates, potassium hydroxide, sodium hydroxide, aqueous ammonia, monocarboxylic acids, dicarboxylic acids and polycarboxylic acids which may be used in combination, as well as formalin, as the typical examples. In addition, a water softener (for example, inorganic phosphoric acids, aminopolycarboxylic acids, organic phosphoric acids, aminopolyphosphonic acids, phosphonocarboxylic acids), a fungicide (for example, benzisothiazolinone, isothiazolone, 4-thiazolinebenzimidazole, halogenated phenols), a surfactant, a fluorescent brightening agent, a hardening agent and other various kinds of additives can also be used, and two or more kinds of compounds for the same or different purposes can be used in combination.

As a film pH-adjusting agent for the processed photographic materials, various kinds of ammonium salts, such as ammonium chloride, ammonium nitrate, ammonium sulfate, ammonium phosphate, ammonium sulfite and ammonium thiosulfate, are preferably used.

When the compound of the present invention is incorporated into a color diffusion transfer photographic material, the dye image-providing compound to be used in combination with the silver halide emulsion layer is a negative type or positive type one. The positive type is initially mobile or non-mobile in the photographic element after processed with an alkaline processing composition.

As negative type dye image-providing compounds which may advantageously be used in the present invention, there are couplers capable of forming or releasing a dye by reaction with an oxidized color developing agent, and examples of such couplers are described in U.S. Pat. No. 3,227,550 and Canadian Patent No. 602,607. As negative type dye image-providing compounds which may be preferably used in the present invention, there are also dye-releasing redox compounds which may release a dye by reaction with a developing agent in the form of an oxidized state or with an electron transferring agent. Typical examples of the compounds are described in U.S. Pat. Nos. 3,928,312, 4,135,929, 4,055,428, 4,336,322 and 4,053,312.

As non-mobile positive type dye-providing compounds which may be used in the present invention, there are compounds which may release a diffusible dye after having received no electron (or that is, not having been reduced) or having received at least one electron (or that is, having been reduced) during photographic processing under alkaline conditions, and specific examples of the compounds are described in U.S. Pat. Nos. 4,199,354, 3,980,479, 4,199,355, 4,139,379, 4,139,389 and 4,232,107 and JP-A-No. 53-69033.

In addition, positive type dye image-providing compounds which are initially mobile in an alkaline photographic processing condition are also useful in the photographic element of the present invention. Specific examples of the compounds of this type are color developing agents, and specific examples thereof are described in U.S. Pat. Nos. 3,482,972 and 3,880,658.

The dyes to be formed from the dye image-providing compounds for use in the present invention may be ready-made dyes or dye precursors which may be converted into the corresponding dyes in the photographic processing step or in any other additional processing step, and the final image dyes may or may not be metal-complexed. As typical dye structures useful for the present invention, there may be mentioned azo dyes, azomethine dyes, anthraquinone dyes and phthalocyanine dyes which have or have not been metal-complexed. Above all, cyan, magenta and yellow dyes are especially important among them.

As one kind of dye precursor, dye-releasing redox compounds with a dye moiety whose light-absorption has been temporarily shifted in a light-sensitive element may also be used in the present invention. Specific examples of the compounds are described in U.S. Pat. Nos. 4,310,612, T-999,003, 3,336,287, 3,579,334 and 3,982,946, British Patent No. 1,467,317 and JP-A-No. 57-158638.

The process of forming a color diffusion transfer image using the dye-releasing redox compound as above is described in *Photographic Science and Engineering,* Vol. 20, No. 4, pages 155 to 164 (July/August, 1976).

In the process, any silver halide developing agent may be used, provided that this may oxidize the dye-releasing redox compound by cross-oxidation. The developing agent may be incorporated into an alkaline processing composition, or alternatively, may be incorporated into any appropriate layer of the photographic element. Examples of developing agents which may be used in the present invention include the hydroquinones described in JP-A-No. 56-16131, aminophenols, phenylenediamines and pyrazolidinones {for example, phenidone, 1-phenyl-3-pyrazolidinone, dimezone (that is, 1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone, 1-phenyl-4-methyl-4-oxymethyl-3-pyrazolidinone}.

The processing composition to be used for processing photographic elements in accordance with a color diffusion transfer process suitably contains a base such as sodium hydroxide, potassium hydroxide, sodium carbonate or sodium phosphate and has a pH value of about 9 or more, and preferably has an alkaline strength of about pH 11.5 or more. The processing composition may contain an antioxidant such as sodium sulfite, ascorbic acid salts or piperidinohexose reductone, or this may also contain a silver ion concentration-adjusting agent such as potassium bromide. Further, this may also contain a viscosity-increasing agent such as hydroxyethyl cellulose or sodium carboxymethyl cellulose.

The present invention can be applied to various kinds of color photographic materials. As specific examples of the materials, there are color negative films for general use or for movies, color reversal films for slides or televisions, as well as color papers, color positive films, color diffusion transfer direct positive photographic materials and color reversal papers. The present invention may also be applied to the black-and-white photographic materials (where three color couplers are mixed) described in *Research Disclosure,* RD No. 17123 (July, 1978).

The following examples are intended to illustrate the present invention but not to restrict it in any way. Unless otherwise indicated, all parts, percents, ratios, etc. are by weight.

The comparative compounds as used in the following examples are as follows:

Comparative Compound (A)

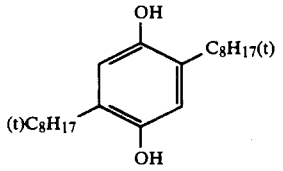

Comparative Compound (B)

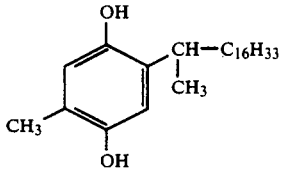

Comparative Compound (C)

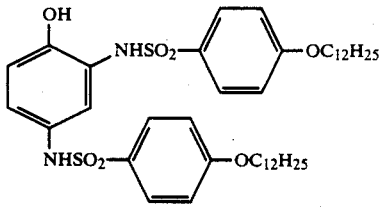

EXAMPLE 1

A multilayer color photographic material (Sample No. 101) was prepared by forming the layers having the compositions shown below on a cellulose triacetate film support with a subbing layer.

The compositions of the photographic layers were as follows. The amount coated was represented by the unit of $g/m^2$ as silver for silver halide and colloidal silver, by the unit of $g/m^2$ for coupler, additive and gelatin, and by the molar number per mol of the silver halide in the same layer for sensitizing dye.

| | |
|---|---|
| First Layer: Antihalation Layer | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Interlayer | |
| Gelatin | 1.0 |
| UV-1 | 0 03 |
| ExC-4 | 0.02 |
| ExF-1 | 0.004 |
| Solv-1 | 0.1 |
| Solv-2 | 0.1 |
| Third Layer: Low-sensitive Red-sensitive Emulsion Layer | |
| Silver iodobromide emulsion (AgI 4 mol %, uniform AgI type, sphere-corresponding diameter 0.5μ, fluctuation coefficient of sphere-corresponding diameter 20%, tabular grains, aspect ratio of diameter/thickness 3.0) | 1.2 as Ag |
| Silver iodobromide emulsion (AgI 3 mol %, uniform AgI type, sphere-corresponding diameter 0.3μ, fluctuation coefficient of sphere-corresponding diameter 15%, spherical grains, aspect ratio of diameter/thickness 1.0) | 0.6 as Ag |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |

-continued

| | |
|---|---|
| Fourth Layer: High-sensitive Red-sensitive Emulsion Layer | |
| Silver iodobromide emulsion (AgI 6 mol %, core/shell (1/1) type with AgI-rich core, sphere-corresponding diameter 0.7μ, fluctuation coefficient of sphere-corresponding diameter 15%, tabular grains, aspect ratio of diameter/thickness 5.0) | 0.7 as Ag |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Laver: Interlayer | |
| Gelatin | 0.5 |
| Cpd-1 | 0.1 |
| Solv-1 | 0.05 |
| Sixth Layer: Low-sensitive Green-sensitive Emulsion Layer | |
| Silver iodobromide emulsion (AgI 4 mol %, core/shell (1/1) type with AgI-rich shell, sphere-corresponding diameter 0.5μ, fluctuation coefficient of sphere-corresponding diameter 15%, tabular grains, aspect ratio of diameter/thickness 4.0) | 0.35 as Ag |
| Silver iodobromide emulsion (AgI 3 mol %, uniform AgI type, sphere-corresponding diameter 0.3μ, fluctuation coefficient of sphere-corresponding diameter 25%, spherical grains, aspect ratio of diameter/thickness 1.0) | 0.19 as Ag |
| Gelatin | 1.02 |
| ExS-3 | $5 \times 10^{-4}$ |
| ExS-4 | $3 \times 10^{-4}$ |
| ExS-5 | $1 \times 10^{-4}$ |
| ExM-8 | 0.36 |
| ExM-9 | 0.07 |
| ExM-10 | 0.02 |
| ExY-11 | 0.03 |
| Solv-1 | 0.3 |
| Solv-4 | 0.05 |
| Seventh Layer: High-sensitive Green-sensitive Emulsion Layer | |
| Silver iodobromide emulsion (AgI 4 mol %, core/shell (1/3) type with AgI-rich core, sphere-corresponding diameter 0.7μ, fluctuation coefficient of sphere-corresponding diameter 20%, tabular grains, aspect ratio of diameter/thickness 5.0) | 0.8 as Ag |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Donor Layer with Interlayer Effect for Red-sensitive Emulsion Layer | |
| Silver iodobromide emulsion (AgI 2 mol %, core/shell (2/1) type with AgI-rich core, sphere-corresponding diameter 1.0μ, fluctuation coefficient of sphere-corresponding diameter 15%, tabular grains, aspect ratio of diameter/thickness 6.0) | 0.35 as Ag |
| Silver iodobromide emulsion (AgI 2 mol %, core/shell (1/1) type with AgI-rich core, sphere-corresponding diameter 0.4μ, fluctuation coefficient of sphere-corresponding diameter 20%, tabular grains, aspect ratio of diameter/thickness 6.0) | 0.20 as Ag |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow Colloidal Silver | 0.05 |
| Gelatin | 0.5 |
| Cpd-2 | 0.13 |
| Solv-1 | 0.13 |
| Cpd-1 | 0.10 |
| Eleventh Layer: Low-sensitive Blue-sensitive Emulsion Layer | |
| Silver iodobromide emulsion (AgI 4.5 mol %, uniform AgI type, sphere-corresponding diameter 0.7μ, fluctuation coefficient of sphere-corresponding diameter 15%, tabular grains, aspect ratio of diameter/thickness 7.0) | 0.3 as Ag |
| Silver iodobromide emulsion (AgI 3 mol %, uniform AgI type, sphere-corresponding diameter 0.3μ, fluctuation coefficient of sphere-corresponding diameter 25%, tabular grains, aspect ratio of diameter/thickness 7.0) | 0.15 as Ag |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: High-sensitive Blue-sensitive Emulsion Layer | |
| Silver iodobromide emulsion (AgI 10 mol %, AgI-rich core type, sphere-corresponding diameter 1.0μ, fluctuation coefficient of sphere-corresponding diameter 25%, multilayer twin plane tabular grains, aspect ratio of diameter/thickness 2.0) | 0.5 as Ag |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteen Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Silver bromide fine grain emulsion (AgI 2 mol %, uniform AgI type, sphere-corresponding diameter 0.07μ) | 0.5 as Ag |
| Gelatin | 0.45 |
| Polymethyl methacrylate grains (diameter 1.5μ) | 0.2 |
| H-1 | 0.4 |
| Cpd-5 | 0.5 |
| Cpd-6 | 0.5 |

The layers contained an emulsion stabilizer (Cpd-3, 0.04 g/m$^2$) and a surfactant (Cpd-4, 0.02 g/m$^2$) as coating aids, in addition to the above-mentioned components.

The components used in the above-mentioned layers were as follows:

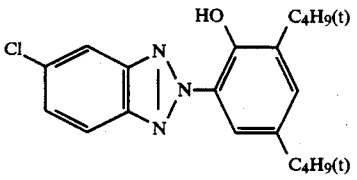
UV-1
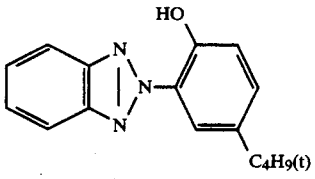
UV-2
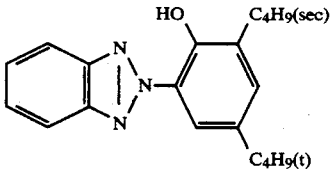
UV-3
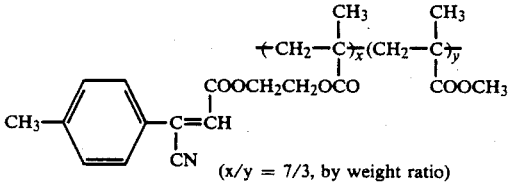
UV-4
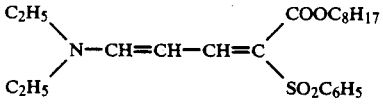
UV-5
Tricresyl Phosphate — Solv-1
Dibutyl Phthalate — Solv-2
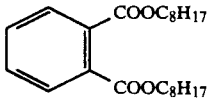
Solv-3
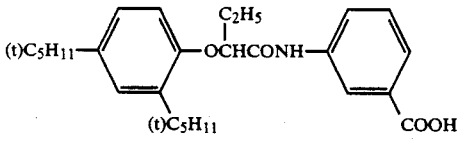
Solv-4
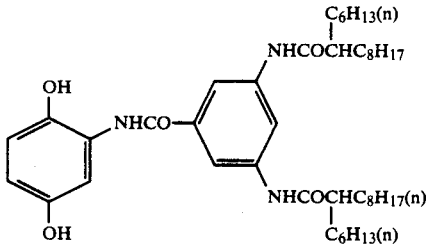
Cpd-1
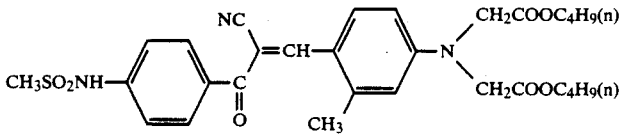
Cpd-2

-continued
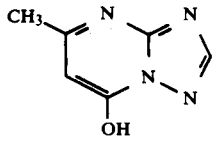
Cpd-3
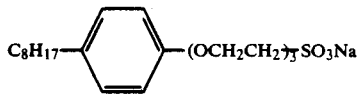
Cpd-4
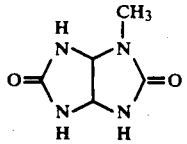
Cpd-5
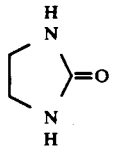
Cpd-6
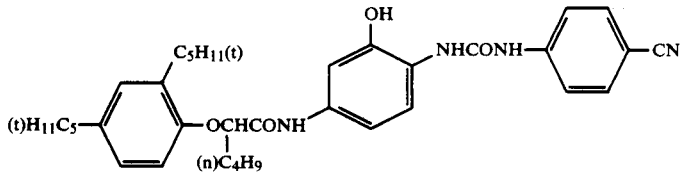
ExC-1
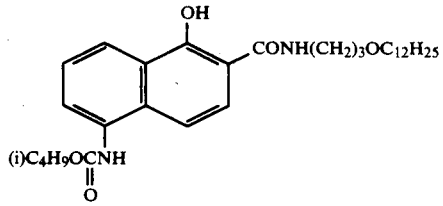
ExC-2
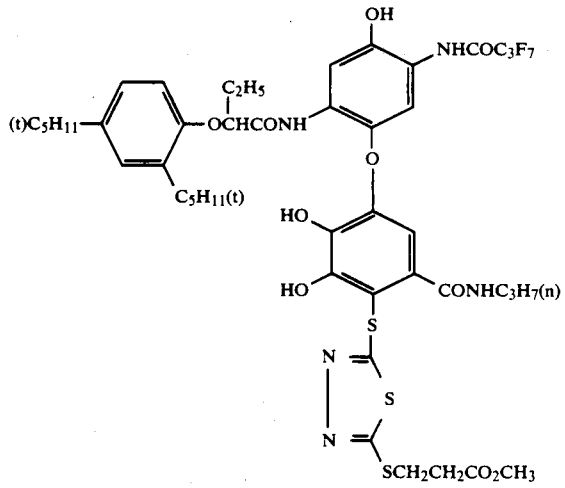
ExC-3

-continued
ExC-4
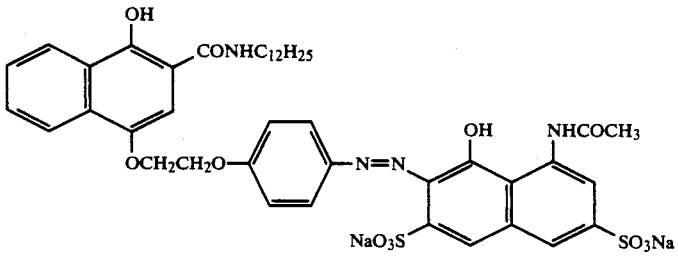
ExC-5
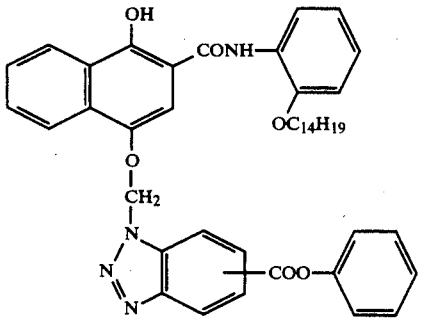
ExC-6
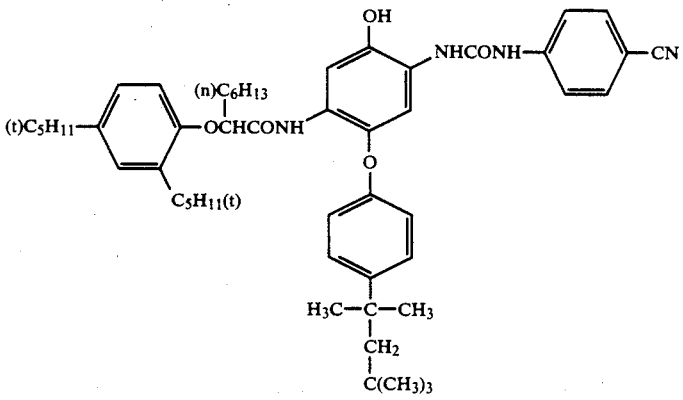
ExC-7
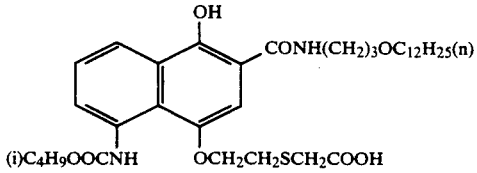
ExM-8
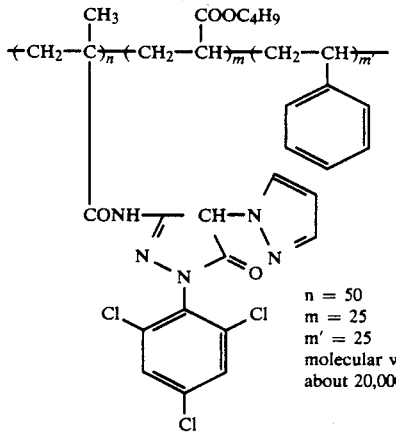
n = 50
m = 25
m′ = 25
molecular weight:
about 20,000

-continued
ExM-9
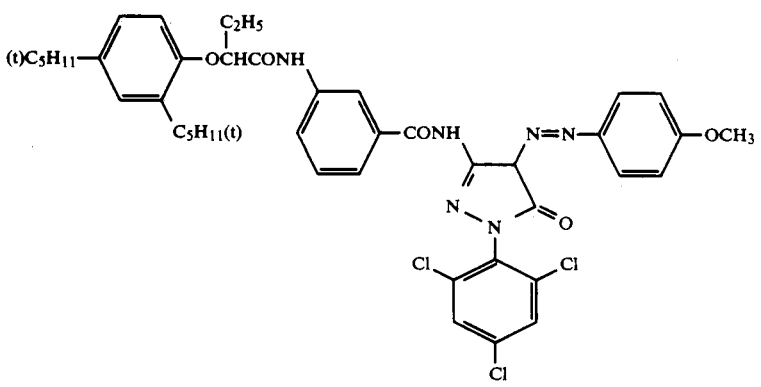
ExM-10
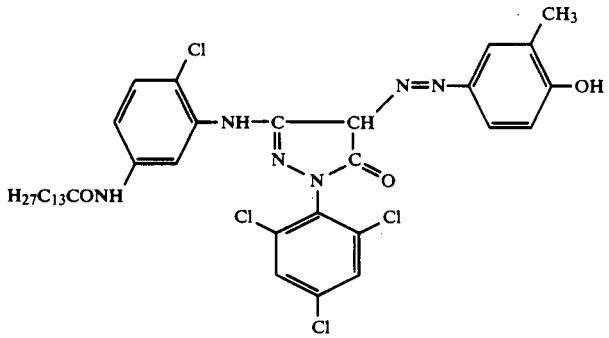
ExY-11
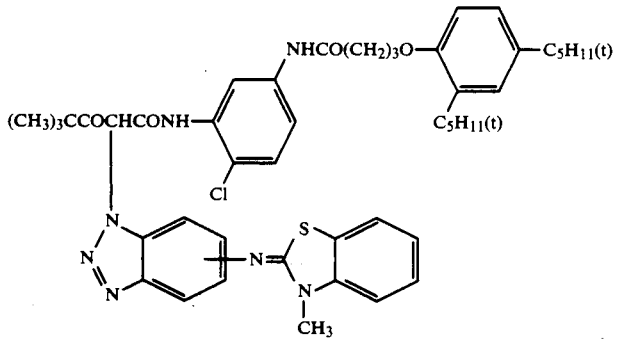
ExM-12
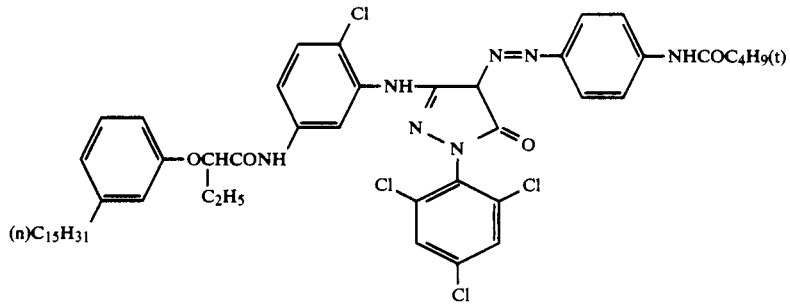

-continued
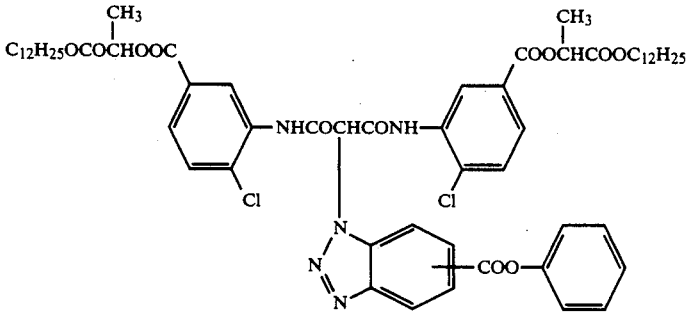
ExY-13
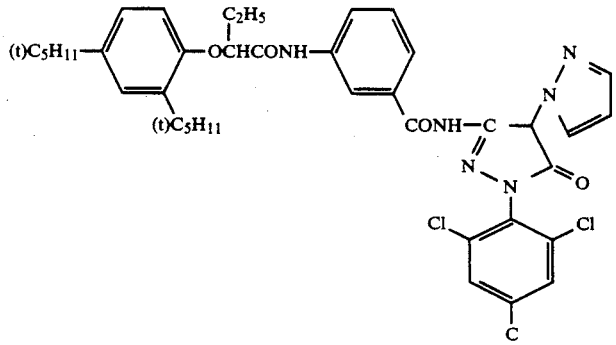
ExM-14
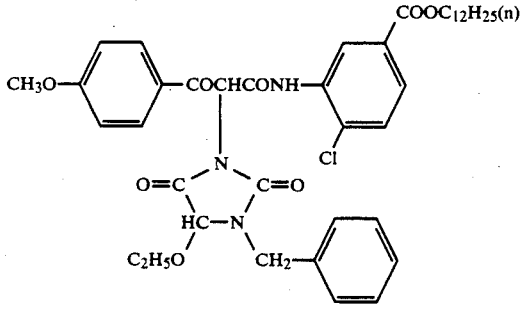
ExY-15
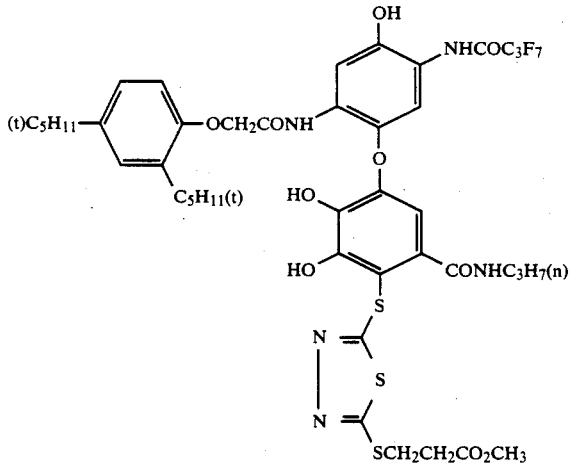
EC-16
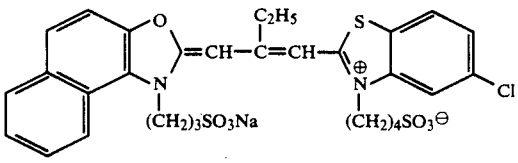
ExS-1

-continued

ExS-2

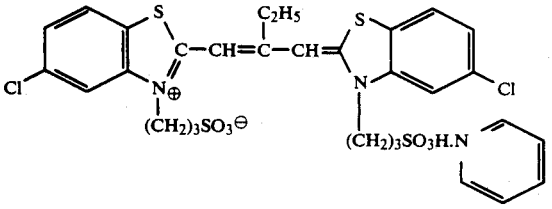

ExS-3

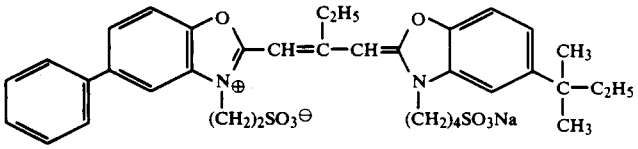

ExS-4

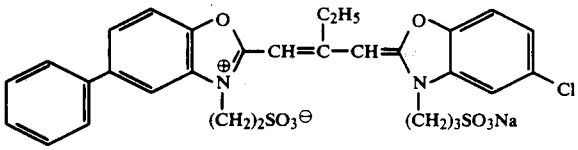

ExS-5

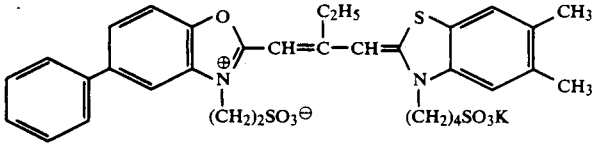

ExS-6

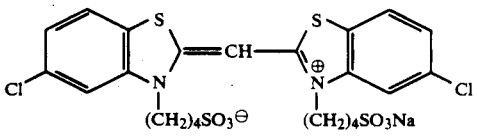

H-1

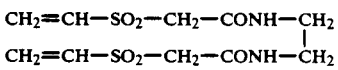

ExF-1

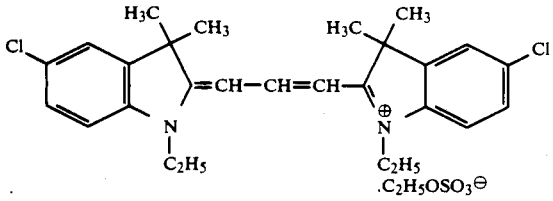

Preparation of Sample Nos. 102 to 104

Sample Nos. 102 to 104 were prepared in the same manner as Sample No. 101, except that Cpd-1 in the fifth layer of Sample No. 101 was replaced by the same weight of Comparative Compounds (A), (B), and (C), respectively.

Preparation of Sample Nos. 105 to 108

Sample Nos. 105 to 108 were prepared in the same manner as Sample No. 101, except that Cpd-1 in the fifth layer of Sample No. 101 was replaced by the same weight of polymer Nos. 3, 4, 8 and 13 of the invention, respectively.

Sample No. 101 was exposed and processed with Color Negative Processor FP-350 (manufactured by Fuji Photo Film Co., Ltd.) in accordance with the procedure mentioned below, until the total amount of the replenisher used became three times of the tank capacity of the mother solution.

| | Processing Steps | | | |
|---|---|---|---|---|
| Processing Step | Processing Time | Processing Temperature | Amount of Replenisher | Tank Capacity |
| Color Development | 3 min 15 sec | 38° C. | 45 ml | 10 liters |
| Bleaching | 1 min 00 sec | 38° C. | 20 ml | 4 liters |
| Bleach-fixation | 3 min 15 sec | 38° C. | 30 ml | 10 liters |
| Rinsing (1) | 40 sec | 35° C. | (Counter-current system from (2) to (1)) | 4 liters |
| Rinsing (2) | 1 min 00 sec | 35° C. | 30 ml | 4 liters |
| Stabilization | 40 sec | 38° C. | 20 ml | 4 liters |

-continued

| Processing Step | Processing Time | Processing Temperature | Amount of Replenisher | Tank Capacity |
|---|---|---|---|---|
| | Processing Steps | | | |
| Drying | 1 min 15 sec | 55° C. | | |

The amount of replenisher shown above is based on the photographic material (35 mm width×1 m length) processed.

In the above process, the amount of the bleach-fixing solution as brought into the rinsing step together with the material being processed was 2 ml per the material (35 mm width×1 m length), Next, the compositions of the processing solutions used are mentioned below.

Color Developer

| | Mother Solution (g) | Replenisher (g) |
|---|---|---|
| Diethylenetriaminepentaacetic acid | 1.0 | 1.0 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-Ethyl-N-β-hydroxyethylamino)-2-methylaniline sulfate | 4.5 | 5.5 |
| Water to make | 1.0 l | 1.0 l |
| pH | 10.05 | 10.10 |

Bleaching Solution: (Mother solution and replenisher were the same.)

| | |
|---|---|
| Ethylenediaminetetraacetic acid iron(III) ammonium dihydrate | 120.0 g |
| Ethylenediaminetetraacetic acid disodium salt | 10.0 g |
| Ammonium bromide | 100.0 g |
| Ammonium nitrate | 10.0 g |
| Bleaching accelerator | 0.005 mol |

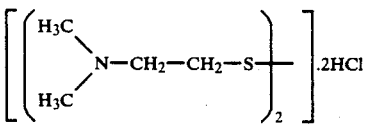

| | |
|---|---|
| Aqueous ammonia (27 wt %) | 15.0 ml |
| Water to make | 1.0 l |
| pH | 6.3 |

Bleach-fixing Solution: (Mother solution and replenisher were the same.)

| | |
|---|---|
| Ethylenediaminetetraacetic acid iron (III) ammonium dihydrate | 50.0 g |
| Ethylenediaminetetraacetic acid disodium salt | 5.0 g |
| Sodium sulfite | 12.0 g |
| Ammonium thiosulfate aqueous solution (70 wt %) | 240.0 ml |
| Aqueous ammonia (27 wt %) | 6.0 ml |
| Water to make | 1.0 l |
| pH | 7.2 |

Rinsing Water: (Mother solution and replenisher were the same.)

A tap water was passed through a mixed bed column filled with an H-type strong acid cation exchange resin (Amberlite® IR-120 B, manufactured by Rohm & Haas Co.) and an OH-type anion exchange resin (Amberlite® IR-400, manufactured by Rohm & Haas Co.) so that the calcium ion concentration and the magnesium ion concentration were both reduced to 3 mg/liter or less, and then 20 mg/liter of sodium dichloroisocyanurate and 150 mg/liter of sodium sulfate were added thereto.

The resulting solution had a pH value of from 6.5 to 7.5.

Stabilizing Solution: (Mother solution and replenisher were the same.)

| | |
|---|---|
| Formalin (37 wt %) | 2.0 ml |
| Polyoxyethylene-p-monononylphenyl ether (mean polymerization degree: 10) | 0.3 g |
| Ethylenediaminetetraacetic acid disodium salt | 0.05 g |
| Water to make | 1.0 l |
| pH | 5.0 to 8.0 |

Afterwards, the above-mentioned samples were imagewise exposed in red and then processed for color development in accordance with the above-mentioned procedure.

The magenta color density of each of the thus developed samples was measured with a green filter. The difference (D-1) between the magenta density by the exposure of giving the maximum cyan color density and the magenta density by the exposure of giving the minimum cyan color density was calculated and the degree of the mixing of the cyan color part into the magenta part was obtained, and the results were summarized in Table 5 below.

On the other hand, the above-mentioned samples were stored at 40° C. and 80% RH for 4 days and then imagewise exposed in green and processed for color development in accordance with the above-mentioned procedure.

The magenta color density of each of the thus developed samples was measured with a green filter. The maximum magenta color density (D-2) was shown in Table 1 below.

TABLE 5

| Sample No. | Compound in 5th Layer | D-1 | D-2 |
|---|---|---|---|
| 101 (Comparison) | Cpd-1 | 0.12 | 3.33 |
| 102 (Comparison) | Comparative Compound (A) | 0.18 | 3.36 |
| 103 (Comparison) | Comparative Compound (B) | 0.17 | 3.42 |
| 104 (Comparison) | Comparative Compound (C) | 0.13 | 3.17 |
| 105 (The Invention) | Polymer No. 3 | 0.09 | 3.34 |
| 106 (The Invention) | Polymer No. 4 | 0.07 | 3.32 |
| 107 (The Invention) | Polymer No. 8 | 0.10 | 3.38 |
| 108 (The Invention) | Polymer No. 13 | 0.09 | 3.35 |

The smaller value of (D-1) means that the color stain in the processed sample was less. Accordingly, it can be seen that the polymers of the present invention have better color stain-preventing action. In the samples containing the polymer of the present invention, the value of (D-2) was comparatively large and accordingly, it can be seen that the samples of the present invention are excellent in storage stability.

EXAMPLE 2

A light-sensitive sheet (A) was prepared by coating the following layers in order on a transparent polyethylene terephthalate film support.

(1) Mordant layer containing 3.0 g/m$^2$ of copoly(styrene-N-vinylbenzyl-N,N,N-trihexylammonium chloride) and 3.0 g/m$^2$ of gelatin.

(2) Light-reflective layer containing 20 g/m$^2$ of titanium dioxide and 2.0 g/m$^2$ of gelatin.

(3) Light-shielding layer containing 3.0 g/m$^2$ of carbon black and 2.0 g/m$^2$ of gelatin.

(4) Layer containing 4.65 g/m$^2$ of magenta dye-releasing redox compound having the following structural formula and 1.2 g/m$^2$ of gelatin.

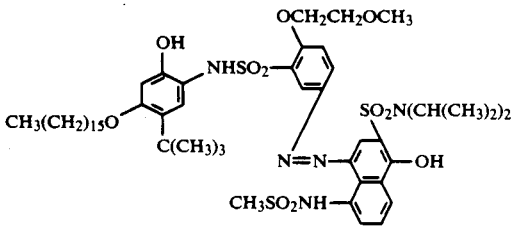

(5) Layer containing 1.2 g/m$^2$ (as silver) of green-sensitive internal latent image-type direct reversal silver halide emulsion, 1.3 g/m$^2$ of gelatin, 0.04 mg/m$^2$ of nucleating agent having the following structural formula and 3.12 g/m$^2$ of sodium 2-sulfo-5-n-pentadecylhydroquinone.

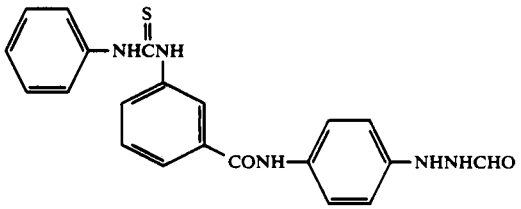

(6) Layer containing 0.45 g/m$^2$ of polymer No. 2 of the invention and 0.2 g/m$^2$ of tricyclohexyl phosphate.

(7) Layer containing 0.75 g/m$^2$ of yellow dye-releasing redox compound having the following structural formula, 0.2 g/m$^2$ of tricyclohexyl phosphate and 1.2 g/m$^2$ of gelatin.

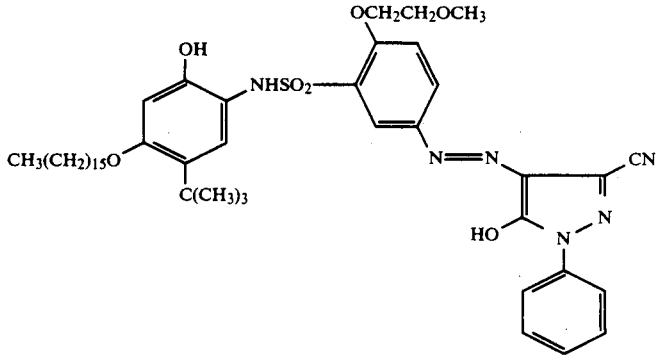

(8) Layer containing 1.0 g/m$^2$ of gelatin.

In the same manner, the following light-sensitive sheet (B) and comparative light-sensitive sheets (C) and (D) were prepared.

Light-sensitive Sheet (B): This was same as the sheet (A), except that the color stain-preventing agent in the layer (6) of the sheet (A) was replaced by the same weight of polymer No. 5 of the invention.

Light-sensitive Sheet (C): This was same as the sheet (A), except that the color stain-preventing agent in the layer (6) of the sheet (A) was replaced by the same weight of Comparative Compound (A).

Light-sensitive Sheet (D): This was same as the sheet (A), to the exclusion of layers (7) and (8) of the sheet (A).

On the other hand, a cover sheet was prepared by coating the following layers in order on a transparent polyester support.

(1) Layer (7 μ thick) containing 17 g/m$^2$ of polyacrylic acid, 0.06 g/m$^2$ of N-hydroxysuccinimidobenzenesulfonate and 0.5 g/m$^2$ of ethylene glycol.

(2) Timing layer (2 μ thick) comprising cellulose acetate (acetylation degree 54).

(3) Timing layer (4 μ thick) comprising a copolymer latex of vinylidene chloride and acrylic acid.

A processing solution comprising the following composition was prepared.

| | |
|---|---|
| 1-Phenyl-4-hydroxymethyl-4-methyl-3-pyrazolidone | 13 g |
| Methylhydroquinone | 0.3 g |
| 5-Methylbenzotriazole | 3.5 g |
| Sodium sulfite (anhydride) | 0.2 g |
| Carboxymethyl cellulose sodium salt | 58 g |
| Potassium hydroxide (28 wt % aqueous solution) | 200 cc |
| Benzyl alcohol | 1.5 cc |
| Carbon black | 150 g |
| Water | 685 cc |

Each of the above-mentioned light-sensitive sheets (A) to (D) was wedgewise exposed and then combined with a container containing the above-mentioned processing solution and the above-mentioned cover sheet. The thus combined sheets were pressed with a pressing member at a temperature of 25° C. or 35° C. so that the processing solution was spread in a thickness of 80 μ between the sheets to obtain a transferred color image. The transferred image was measured with a color densitometer to obtain Dg (green filter density) and Db (blue filter density). The value of Db when Dg=2.0 was shown in Table 6 below.

TABLE 6

| | Processing Temperature 35° C. | | | Processing Temperature 25° C. | | |
|---|---|---|---|---|---|---|
| | Dg | Db | Difference in Db from Sheet (D) | Dg | Db | Difference in Db from Sheet (D) |
| Light-sensitive Sheet (A) (The Invention) | 2.00 | 0.43 | 0.09 | 2.00 | 0.40 | 0.70 |
| Light-sensitive Sheet (B) (The Invention) | 2.00 | 0.41 | 0.07 | 2.00 | 0.38 | 0.05 |
| Light-sensitive Sheet (C) (Comparison) | 2.00 | 0.53 | 0.19 | 2.00 | 0.49 | 0.16 |
| Light-sensitive Sheet (D) (*) | 2.00 | 0.34 | — | 2.00 | 0.33 | — |

(*)Value when no color turbidity appeared.

In the light-sensitive sheets (A) to (C), the color stain-preventing agent-containing layer (6) was coated in order that, when the oxidation product of the developing agent as formed in the green-sensitive silver halide emulsion-containing layer (5) was diffused to the yellow dye-releasing redox compound-containing layer (7), which was not adjacent to the silver halide emulsion layer (5), through the layer (6), the oxidation product of the developing agent could not react with the yellow dye-releasing redox compound to release a yellow dye (whereby the magenta color turbidity caused by introduction of yellow into magenta to worsen the magenta hue could be prevented). Accordingly, the capacity of the color stain-preventing agent-containing layer (6) in these light-sensitive sheets (A), (B) and (C) may be evaluated from the difference of the respective value Db from that of the sheet (D), which means the color turbidity. The light-sensitive sheets (A) and (B) containing polymers of the present invention have a much lower color turbidity value than the comparative sheets (C) and (D), and thus it is apparent that the former two have a higher color stain-preventing capacity than the latter two.

EXAMPLE 3

A multilayer silver halide photographic material (Sample No. 301) was prepared by forming the layers having the compositions shown below on a paper support, both surfaces of which had been coated with polyethylene. The coating compositions for the layers were prepared as follows.

Coating Composition for First Layer 27.2 cc of ethyl acetate and 7.7 cc (8.0 g) of high boiling solvent (Solv-1) were added to 19.1 g of yellow coupler (ExY-1) and 4.4 g of color image stabilizer (Cpd-1) and dissolved, and the resulting solution was dispersed by emulsification in 185 cc of an aqueous 10 wt% gelatin solution containing 8 cc of a 10 wt% sodium dodecylbenzenesulfonate solution. The emulsified dispersion and the emulsions EM7 and EM8 were blended and dissolved to obtain a coating composition for the first layer whereupon the gelatin concentration was adjusted as shown below. Coating compositions for the second layer to the seventh layer were also prepared in the same manner as the first layer. The gelatin hardening agent for each layer was 1-hydroxy-3,5-dichloro-s-triazine sodium salt. As a tackifier, (Cpd-2) was used.

The layer constitution was as mentioned below. The amount of each component coated was represented by the unit of g/m². The silver halide emulsion coated was represented by the unit of g/m² as silver.

| | |
|---|---|
| Support: Polyethylene Laminate Paper (This contained a white pigment ($TiO_2$) and a bluish dye in the polyethylene in the side of the first layer.) | |
| First Layer: Blue-sensitive Layer | |
| Monodispersed silver chlorobromide emulsion (EM7) (spectrally sensitized with sensitizing dye (ExS-1)) | 0.15 |
| Monodispersed silver chlorobromide emulsion (EM8) (spectrally sensitized with sensitizing dye (ExS-1)) | 0.15 |
| Gelatin | 1.86 |
| Yellow coupler (ExY-1) | 0.82 |
| Color image stabilizer (Cpd-1) | 0.19 |
| Solvent (Solv-1) | 0.35 |
| Second Layer: Color Mixing Preventing Layer | |
| Gelatin | 0.99 |
| Color mixing preventing agent (Cpd-3) | 0.05 |
| Third Layer: Green-sensitive Layer | |
| Monodispersed silver chlorobromide emulsion (EM9) (spectrally sensitized with sensitizing dyes (ExS-2, 3)) | 0.12 |
| Monodispersed silver chlorobromide emulsion (EM10) (spectrally sensitized with sensitizing dyes (ExS-2, 3)) | 0.24 |
| Gelatin | 1.24 |
| Magenta coupler (ExM-1) | 0.39 |
| Color image stabilizer (Cpd-4) | 0.25 |
| Color image stabilizer (Cpd-5) | 0.12 |
| Solvent (Solv-2) | 0.25 |
| Fourth Layer: Ultraviolet Absorbing Layer | |
| Gelatin | 1.60 |
| Ultraviolet absorbent (Cpd-6/Cpd-7/Cpd-8 = 3/2/6, by weight) | 0.70 |
| Color mixing preventing agent (Cpd-9) | 0.05 |
| Solvent (Solv-3) | 0.42 |
| Fifth Layer: Red-sensitive Layer | |
| Monodispersed silver chlorobromide emulsion (EM11) (spectrally sensitized with sensitizing dyes (ExS-4, 5)) | 0.07 |
| Monodispersed silver chlorobromide emulsion (EM12) (spectrally sensitized with sensitizing dyes (Exs-4, 5)) | 0.16 |
| Gelatin | 0.92 |
| Cyan coupler (ExC-1) | 1.46 |
| Cyan coupler (ExC-1) | 1.84 |
| Color image stabilizer (Cpd-7/Cpd-8/Cpd-10 = 3/4/2, by weight) | 0.17 |
| Polymer for dispersion (Cpd-11) | 0.11 |
| Solvent (Solv-1) | 0.20 |
| Sixth Layer: Ultraviolet Absorbing Layer | |
| Gelatin | 0.54 |
| Ultraviolet absorbent (Cpd-6/Cpd-8/Cpd-10 = 1/5/3, by weight) | 0.21 |
| Solvent (Solv-4) | 0.08 |
| Seventh Layer: Protective Layer | |
| Gelatin | 1.33 |
| Acrylic modified copolymer of polyvinyl alcohol (modification degree 17%) | 0.17 |
| Liquid paraffin | 0.03 |

As anti-irradiation dyes, Cpd-12 and Cpd-13 were used. For each layer, Alkanol XC® (by DuPont Co.), sodium alkylbenzenesulfonate, succinic acid ester and Megafac® F-120 (by Dai-Nippon Ink Co.) were used as a coating aid for the emulsified dispersion. As a stabilizer for the silver halide, Cpd-14 and Cpd-15 were used.
The details of the emulsions used were as follows.
| Emulsion | Shape | Grain Size (μm) | Br Content (mol %) | Fluctuation Coefficient |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |
Fluctuation Coefficient = Standard Deviation/Mean Grain Size
ExY-1
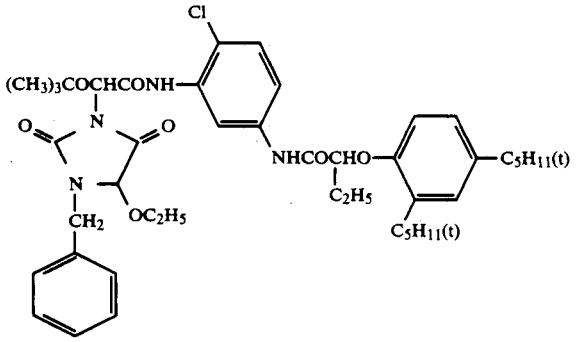
ExM-1
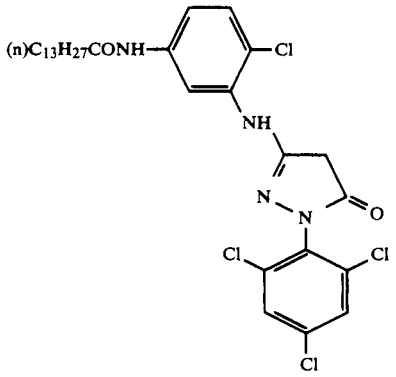
ExC-1
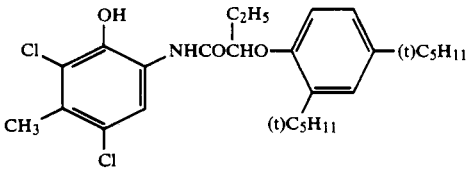
ExC-2
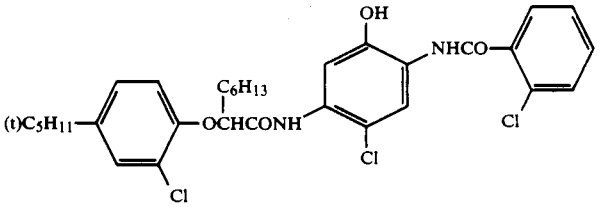
Cpd-1
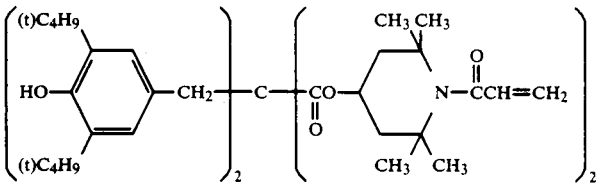

-continued
Cpd-2
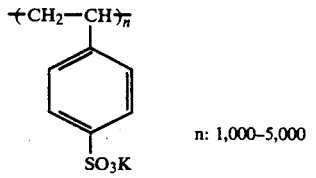
Cpd-3
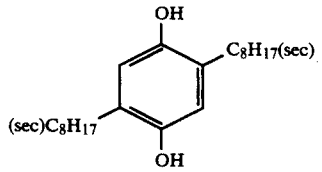
Cpd-4
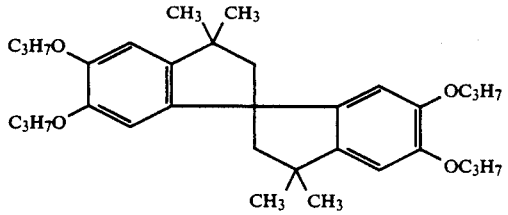
Cpd-5
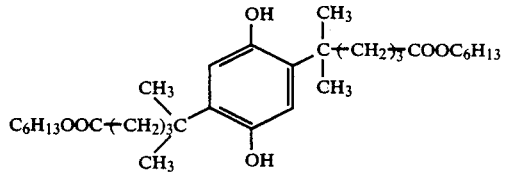
ExS-1
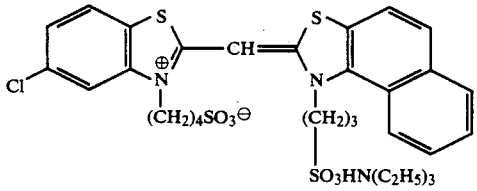
ExS-2
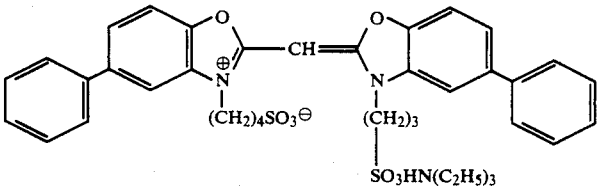
ExS-3
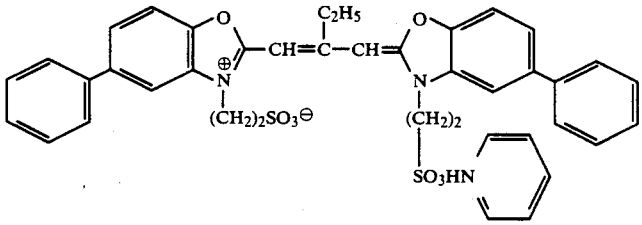
ExS-4
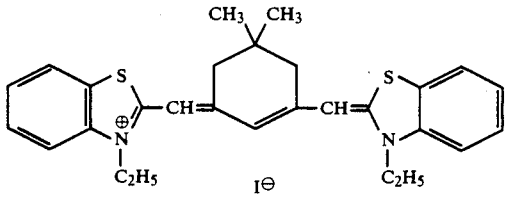

-continued
ExS-5
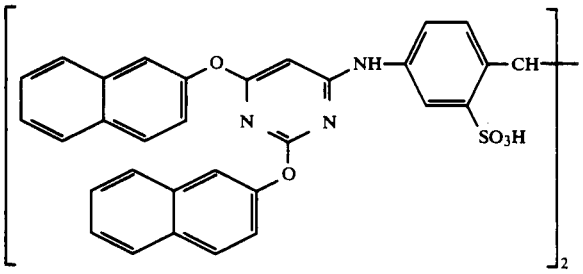
Cpd-6
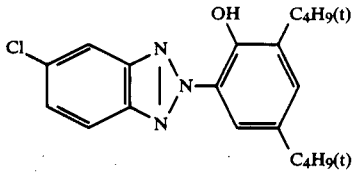
Cpd-7
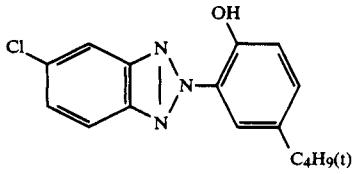
Cpd-8
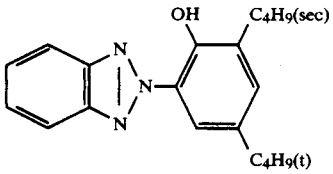
Cpd-9
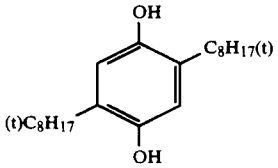
Cpd-10
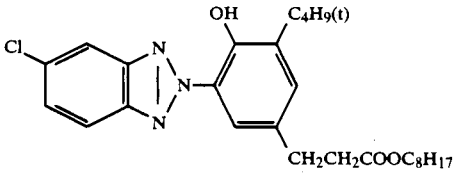
Cpd-11
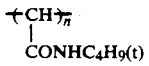
(n = 100–1000)
molecular weight: 100,000
Cpd-12
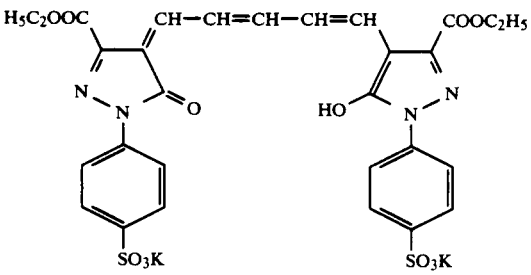

-continued

| | |
|---|---|
| Cpd-13 | 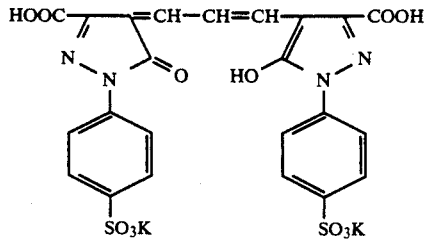 |
| Cpd-14 | 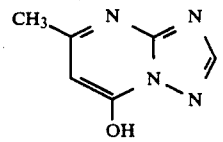 |
| Cpd-15 | 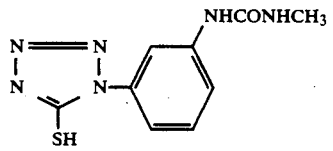 |
| Solv-1 | Dibutyl phthalate |
| Solv-2 | Tricresyl phosphate |
| Solv-3 | Trioctyl phosphate |
| Solv-4 | Trinonyl phosphate |

Preparation of Sample Nos. 302 and 303

Sample Nos. 302 and 303 were prepared in the same manner as Sample No. 301, except that the color mixing preventing agent (Cpd-3) in the second layer of Sample No. 301 was replaced by the same weight of Comparative Compound (A) and (B), respectively.

Preparation of Sample Nos. 304 to 306

Sample Nos. 304 to 306 were prepared in the same manner as Sample No. 301, except that the color mixing preventing agent (Cpd-3) in the second layer of Sample No. 301 was replaced by the same weight of polymer Nos. 1, 6 and 10, respectively.

The above-mentioned samples were imagewise exposed in blue and then processed for color development in accordance with the procedure mentioned below.

The magenta color density of each of the thus developed samples was measured with a green filter. The difference between the magenta density by the exposure of giving the maximum yellow color density and the magenta density by the exposure of giving the minimum yellow color density was calculated and the degree of the mixing of the yellow color part into the magenta part was obtained, and the results were shown in Table 7 below.

The processing steps were as follows.

| Processing Step | Temperature (°C.) | Time |
|---|---|---|
| Color development | 35 | 45 sec |
| Bleach-fixation | 30 to 35 | 45 sec |
| Rinsing (1) | 30 to 35 | 20 sec |
| Rinsing (2) | 30 to 35 | 20 sec |
| Rinsing (3) | 30 to 35 | 20 sec |
| Rinsing (4) | 30 to 35 | 30 sec |
| Drying | 70 to 80 | 60 sec |

(The rinsing step was conducted by three-tank countercurrent system from fourth rinsing tank (rinsing (4)) to the first rinsing tank (rinsing (1)).)

The processing solutions had the following compositions.

Color Developer

| | |
|---|---|
| Water | 800 ml |
| Ethylenediamine-N,N,N,N-tetramethylene-phosphonic acid | 1.5 g |
| Triethylenediamine (1,4-diazabicyclo-(2.2.2)octane) | 5.0 g |
| Sodium chloride | 1.4 g |
| Potassium carbonate | 25.0 g |
| N-Ethyl-N-(β-methanesulfonamidoethyl)-3-methyl-4-aminoaniline sulfate | 5.0 g |
| N,N-Diethylhydroxylamine | 4.2 g |
| Brightening agent (UVITEX ® CR, by Ciba-Geigy AG) | 2.0 g |
| Water to make | 1000 ml |
| pH (25° C.) | 10.10 |

Bleach-fixing Agent

| | |
|---|---|
| Water | 400 ml |
| Ammonium thiosulfate (70 wt. %) | 100 ml |
| Sodium sulfite | 18 g |
| Ethylenediaminetetraacetic acid iron(III) ammonium complex | 55 g |
| Ethylenediaminetetraacetic acid disodium salt | 3 g |
| Ammonium bromide | 40 g |
| Glacial acetic acid | 8 g |
| Water to make | 1000 ml |
| pH (25° C.) | 5.5 |

Rinsing Solution

Ion-exchanged water (calcium and magnesium: each 3 ppm or less)

TABLE 7

| Sample | Compound | Color Mixing |
|---|---|---|
| 301 (Comparison) | Cpd-3 | 0.11 |
| 302 (Comparison) | Comparative Compound (A) | 0.12 |
| 303 (Comparison) | Comparative Compound (B) | 0.11 |
| 304 (The Invention) | Polymer No. 1 | 0.08 |
| 305 (The Invention) | Polymer No. 6 | 0.09 |
| 306 (The Invention) | Polymer No. 10 | 0.06 |

The results of Table 7 indicate that the color mixing was less in Sample Nos. 304 to 306 of the present invention than in the comparative Sample Nos. 301 to 303.

EXAMPLE 4

A color photographic material (Sample No. 401) was prepared by forming the following first to fourteenth layers on a triacetate base.

The layer constitution was as mentioned below. The amount of each component coated was represented by the unit of g/m$^2$. The silver halide emulsion coated was represented by the unit of g/m$^2$ as silver.

| | |
|---|---|
| First Layer: Anti-halation Layer | |
| Black colloidal silver | 0.30 |
| Gelatin | 2.50 |
| UV-1 | 0.05 |
| UV-2 | 0.10 |
| UV-3 | 0.10 |
| Solv-1 | 0.10 |
| Second Layer: Interlayer | |
| Gelatin | 0.50 |
| Third Layer: Low-sensitive Red-sensitive Layer | |
| Monodispersed silver iodobromide emulsion (AgI 4 mol %, cubic grains, mean grain size 0.3μ, s/r = 0.15) | 0.50 |
| ExS-1 | $1.40 \times 10^{-3}$ |
| ExS-2 | $6.00 \times 10^{-5}$ |
| Gelatin | 0.80 |
| ExC-1 | 0.20 |
| ExC-2 | 0.10 |
| Solv-2 | 0.10 |
| Fourth Layer: Middle-sensitive Red-sensitive Layer | |
| Monodispersed silver iodobromide emulsion (AgI 2.5 mol %, tetradecahedral grains, mean grain size 0.45μ, s/r = 0.15) | 0.50 |
| ExS-1 | $1.60 \times 10^{-3}$ |
| ExS-2 | $6.00 \times 10^{-5}$ |
| Gelatin | 1.00 |
| ExC-1 | 0.30 |
| ExC-2 | 0.15 |
| Solv-2 | 0.20 |
| Fifth Layer: High-sensitive Red-sensitive Layer | |
| Monodispersed silver iodobromide emulsion (AgI 2.5 mol %, tetradecahedral grains, mean grain size 0.60μ, s/r = 0.15) | 0.30 |
| ExS-1 | $1.60 \times 10^{-3}$ |
| ExS-2 | $6.00 \times 10^{-5}$ |
| Gelatin | 0.70 |
| ExC-1 | 0.20 |
| ExC-2 | 0.10 |
| Solv-2 | 0.12 |
| Sixth Layer: Interlayer | |
| Gelatin | 1.0 |
| Cpd-1 | 0.1 |

-continued

| | |
|---|---|
| Solv-1 | 0.03 |
| Solv-2 | 0.08 |
| Solv-3 | 0.12 |
| Cpd-2 | 0.25 |
| Seventh layer: Low-sensitive Green-sensitive Layer | |
| Silver iodobromide emulsion (AgI 3.0 mol %, mixture of normal crystals and twin plane crystals, mean grain size 0.3μ) | 0.65 |
| ExS-3 | $3.30 \times 10^{-3}$ |
| ExS-4 | $1.50 \times 10^{-3}$ |
| Gelatin | 1.50 |
| ExM-1 | 0.10 |
| ExM-2 | 0.25 |
| Solv-2 | 0.30 |
| Eighth Layer: High-sensitive Green-sensitive Layer | |
| Tabular silver iodobromide emulsion (AgI 2.5 mol %, 50% of the projected area of the total grains are grains having an aspect ratio (diameter/thickness) of 5 or more; mean thickness of grains 0.15μ) | 0.70 |
| ExS-3 | $1.30 \times 10^{-3}$ |
| ExS-4 | $5.00 \times 10^{-4}$ |
| Gelatin | 1.00 |
| ExM-3 | 0.25 |
| Cpd-3 | 0.10 |
| Cpd-4 | 0.05 |
| Solv-2 | 0.05 |
| Ninth Layer: Interlayer | |
| Gelatin | 0.50 |
| Tenth Layer: Yellow Filter Layer | |
| Yellow colloidal silver | 0.10 |
| Gelatin | 1.00 |
| Cpd-1 | 0.05 |
| Solv-1 | 0.03 |
| Solv-2 | 0.07 |
| Cpd-2 | 0.10 |
| Eleventh Layer: Low-sensitive Blue-sensitive Layer | |
| Silver iodobromide emulsion (AgI 2.5 mol %, mixture of normal crystals and twin plane crystals, mean grain size 0.7μ) | 0.55 |
| ExS-5 | $1.00 \times 10^{-3}$ |
| Gelatin | 0.90 |
| ExY-1 | 0.50 |
| Solv-2 | 0.10 |
| Twelfth Layer: High-sensitive Blue-sensitive Layer | |
| Tabular silver iodobromide emulsion (AgI 2.5 mol %, 50% of the projected area of the total grains are grains having an aspect ratio (diameter/thickness) of 5 or more; mean thickness of grains 0.13μ) | 1.00 |
| ExS-5 | $1.70 \times 10^{-3}$ |
| Gelatin | 2.00 |
| ExY-1 | 1.00 |
| Solv-2 | 0.20 |
| Thirteenth Layer: Ultraviolet Absorbing Layer | |
| Gelatin | 1.50 |
| UV-1 | 0.02 |
| UV-2 | 0.04 |
| UV-3 | 0.04 |
| Cpd-5 | 0.30 |
| Solv-1 | 0.30 |
| Cpd-6 | 0.10 |
| Fourteenth Layer: Protective Layer | |
| Fine silver iodobromide grains (AgI 1 mol %, mean grain size 0.05μ) | 0.10 |
| Gelatin | 2.00 |
| H-1 | 0.30 |

The compounds used in the above-mentioned layers were as follows.

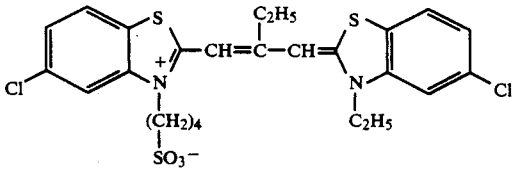
ExS-1
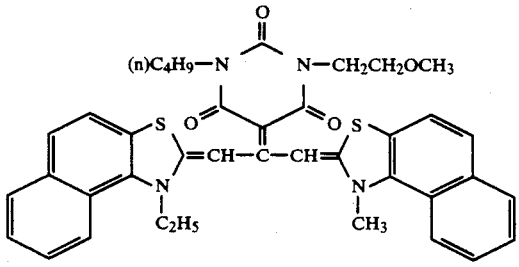
ExS-2
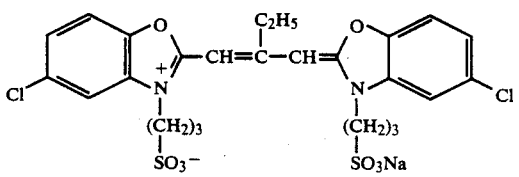
ExS-3
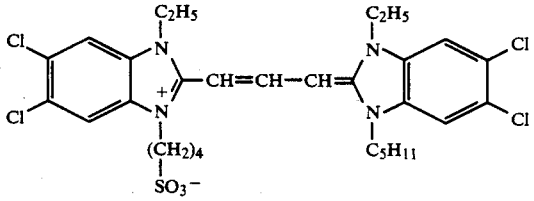
ExS-4
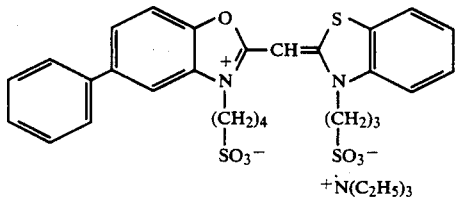
ExS-5
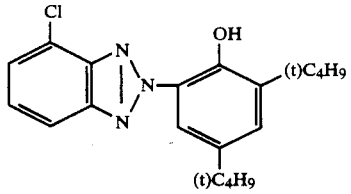
UV-1
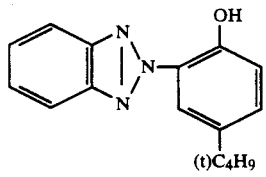
UV-2
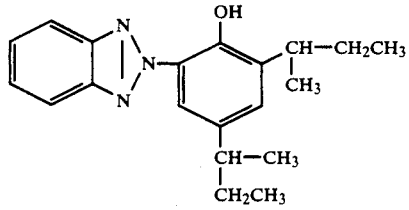
UV-3

-continued
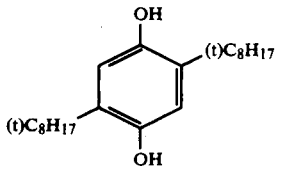
Cpd-1
Poly(ethyl methacrylate)
Cpd-2
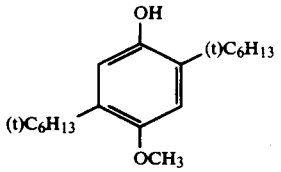
Cpd-3
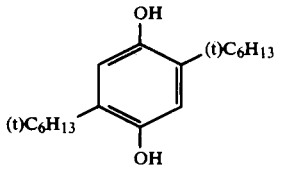
Cpd-4
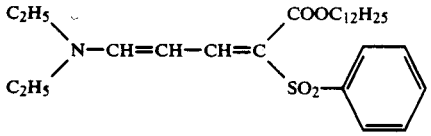
Cpd-5
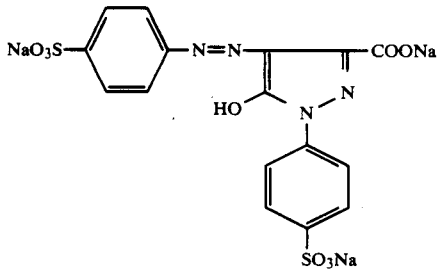
Cpd-6
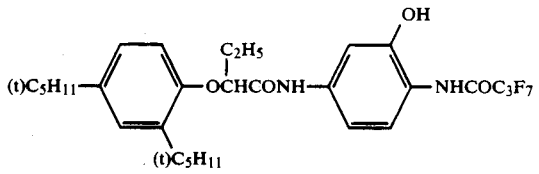
ExC-1
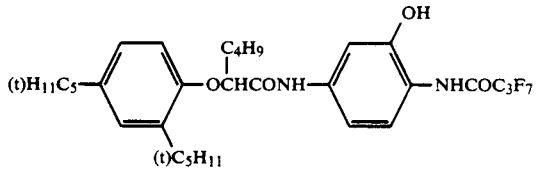
ExC-2

-continued

ExM-1

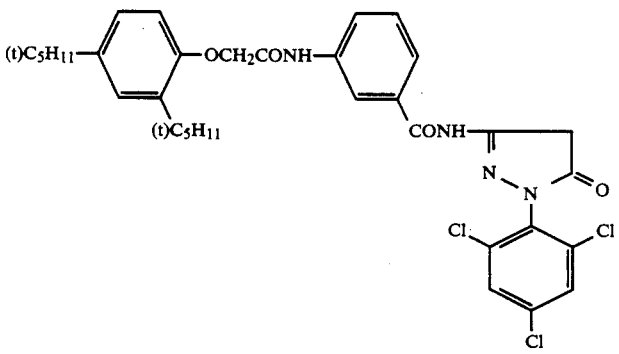

ExM-2

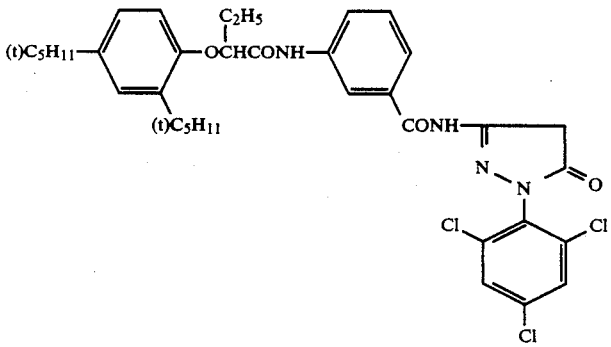

ExM-3

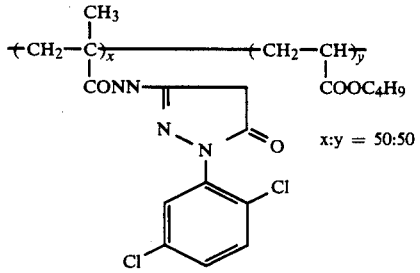

x:y = 50:50

ExY-1

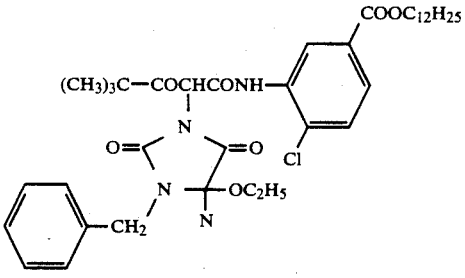

| | |
|---|---|
| Dibutyl phthalate | Solv-1 |
| Tricresyl phosphate | Solv-2 |
| Trinonyl phosphate | Solv-3 |
| 1,2-Bis(vinylsulfonylacetamido)ethane | H-1 |

Preparation of Sample Nos. 402 and 403

Sample Nos. 402 and 403 were prepared in the same manner as Sample No. 401, except that the compound (Cpd-1) in the sixth layer of Sample No. 401 was replaced by the same weight of Comparative Compounds (B) and (C), respectively.

Preparation of Sample Nos. 404 to 407

Sample Nos. 404 to 407 were prepared in the same manner as Sample No. 401, except that the compound (Cpd-1) in the sixth layer of Sample No. 401 was replaced by the same weight of polymer 2, 8, 14 and 21 cf the present invention, respectively.

Sample No. 401 thus prepared was imagewise exposed and then processed with an automatic developing machine in accordance with the procedure mentioned below, until the total amount of the replenisher used for the first developer became three times of the tank capacity of the first developer.

Afterwards, the above-mentioned Sample Nos. 401 to 407 were imagewise exposed in red and then processed for color development in accordance with the reversal processing procedure mentioned below in Table 8.

TABLE 8

| Processing Step | Time | Temperature (°C.) | Tank Capacity (l) | Amount of Replenisher (ml/m²) |
|---|---|---|---|---|
| First Development | 6 min. | 38 | 12 | 2200 |
| First Rinsing | 45 sec. | 38 | 2 | 2200 |
| Reversal | 45 sec. | 38 | 2 | 1100 |
| Color Development | 6 min. | 38 | 12 | 2200 |
| Bleaching | 2 min. | 38 | 4 | 860 |
| Bleach-fixation | 4 min. | 38 | 8 | 1100 |
| Second Rinsing (1) | 1 min. | 38 | 2 | — |
| Second Rinsing (2) | 11 min. | 38 | 2 | 1100 |
| Stabilization | 1 min. | 25 | 2 | 1100 |
| Drying | 1 min. | 65 | — | — |

In the second rinsing step, the replenisher was introduced into the second rinsing tank (2) for a so-called countercurrent system where the solution overflown from the rinsing tank (2) was introduced into the rinsing tank (1).

The processing solutions used had the following compositions.

First Developer

| | Mother Solution | Replenisher |
|---|---|---|
| Nitrilo-N,N,N-trimethylene-phosphonic acid penta-sodium salt | 2.0 g | 2.0 g |
| Sodium sulfite | 30 g | 30 g |
| Hydroquinone.potassium monosulfonate | 20 g | 20 g |
| Potassium carbonate | 33 g | 33 g |
| 1-Phenyl-4-methyl-4-hydroxy-methyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1000 ml | 1000 ml |
| pH | 9.60 | 9.60 |

(pH was adjusted with hydrochloric acid or potassium hydroxide.)

First Rinsing Solution

| | Mother Solution | Replenisher |
|---|---|---|
| Ethylenediaminetetra-methylene phosphonic acid | 2.0 g | (same as mother solution) |
| Disodium phosphate | 5.0 g | |
| Water to make | 1000 ml | |
| pH | 7.00 | |

(pH was adjusted with hydrochloric acid or sodium hydroxide.)

Reversing Solution

| | Mother Solution | Replenisher |
|---|---|---|
| Nitrilo-N,N,N-trimethylene-phosphonic acid penta-sodium salt | 3.0 g | (same as mother solution) |
| Stannous chloride dihydrate | 1.0 g | |
| p-Aminophenol | 0.1 g | |
| Sodium hydroxide | 8 g | |
| Glacial acetic acid | 15 ml | |
| Water to make | 1000 ml | |
| pH | 6.0 | |

(pH was adjusted with hydrochloric acid or sodium hydroxide.)

Color Developer

| | Mother Solution | Replenisher |
|---|---|---|
| Nitrilo-N,N,N-trimethylene-phosphonic acid penta-sodium salt | 2.0 g | 2.0 g |
| Sodium sulfite | 7.0 g | 7.0 g |
| Trisodium phosphate dodecahydrate | 36 g | 36 g |
| Potassium romide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfon-amidoethyl)-3-methyl-4-aminoaniline sulfate | 11 g | 11 g |
| 3,6-Dithiaoctane-1,8-diol | 1.0 g | 1.0 g |
| Water to make | 1000 ml | 1000 ml |
| pH | 11.80 | 12.00 |

(pH was adjusted with hydrochloric acid or potassium hydroxide.)

Bleaching Solution

| | Mother Solution | Replenisher |
|---|---|---|
| Ethylenediaminetetraacetic acid disodium salt dihydrate | 10.0 g | (same as mother solution) |
| Ethylenediaminetetraacetic acid iron(III) ammonium dihydrate | 120 g | |
| Ammonium bromide | 100 g | |
| Ammonium nitrate | 10 g | |
| Bleaching accelerator | 0.005 mol | |

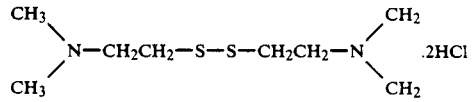

| | | |
|---|---|---|
| Water to make | 1000 ml | |
| pH | 6.30 | |

(pH was adjusted with hydrochloric acid or aqueous ammonia.)

Bleach-fixing Solution

| | Mother Solution | Replenisher |
|---|---|---|
| Ethylenediaminetetraacetic acid iron(III) ammonium dihydrate | 50 g | (same as mother solution) |
| Ethylenediaminetetraacetic acid disodium dihydrate | 5.0 g | |
| Sodium thiosulfate | 80 g | |
| Sodium sulfite | 12.0 g | |
| Water to make | 1000 ml | |
| pH | 6.60 | |

(pH was adjusted with hydrochloric acid or aqueous ammonia.)

Second Rinsing Solution: (Mother solution and replenisher were same.)

A tap water was passed through a mixed bed column filled with an H-type strong acid cation exchange resin (Amberlite® IR-120 B, manufactured by Rohm & Haas Co.) and an OH-type anion exchange resin (Amberlite® IR-400, manufactured by Rohm & Haas Co.) so that the calcium ion concentration and the magnesium ion concentration were both reduced to 3 mg/liter or less, and then 20 mg/liter of sodium dichloroisocyanurate and 1.5 g/liter of sodium sulfate were added thereto.

The resulting solution had a pH value of from 6.5 to 7.5.

Stabilizing Solution

| | Mother Solution | Replenisher |
|---|---|---|
| Formalin (37 wt %) | 5.0 ml | (same as mother solution) |
| Polyoxyethylene-p-monononylphenylether (mean polymerization degree 10) | 0.5 ml | |
| Water to make | 1000 ml | |
| pH | Not adjusted | |

The cyan color density of each of the thus developed samples was measured with a red filter. The maximum cyan color density (D-1) and the minimum cyan color density (D-2) were obtained and the results are shown in Table 4 below.

In addition, the maximum yellow color density and the maximum magenta color density were also measured with a blue filter and a green filter, respectively. The results obtained are shown in Table 9.

TABLE 9

| Sample | Compound | D-1 | D-2 | Y Dmax | M Dmax |
|---|---|---|---|---|---|
| 401 (Comparison) | Cpd-1 | 2.91 | 0.36 | 3.01 | 3.03 |
| 402 (Comparison) | Comparative Compound (B) | 2.85 | 0.42 | 3.02 | 2.96 |
| 403 (Comparison) | Comparative Compound (C) | 2.88 | 0.35 | 3.05 | 2.99 |
| 404 (The Invention) | Polymer No. 2 | 2.87 | 0.30 | 3.04 | 2.96 |
| 405 (The Invention) | Polymer No. 8 | 2.89 | 0.28 | 3.02 | 2.98 |
| 406 (The Invention) | Polymer No. 14 | 2.86 | 0.25 | 3.05 | 2.97 |
| 407 (The Invention) | Polymer No. 12 | 2.91 | 0.29 | 3.04 | 3.00 |

It is noted from the results shown in Table 9 that the Sample Nos. 404 to 407 of the present invention had a lower minimum cyan color density (D-2) than the comparative samples. Accordingly, it can be appreciated that the polymers of the present invention are effective for prevention of color stain and moreover, do not adversely affect the coloration of other layers.

EXAMPLE 5

A multilayer color photographic material (Sample No. 501) was prepared by forming the layers having the compositions shown below on a cellulose triacetate film support with a subbing layer.

The layer constitution was as mentioned below. The amount of each component coated was represented by the unit of g/m$^2$. The amount of the silver halide coated was represented by the unit of g/m$^2$ as silver. The amount of the sensitizing dye coated was represented by mols per mol of the silver halide in the same layer.

Sample No. 50

| | |
|---|---|
| First Layer: Anti-halation Layer | |
| Black colloidal silver | 0.18 as Ag |
| Gelatin | 0.40 |
| Second Layer: Interlayer | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer: First Red-sensitive Emulsion Layer | |
| Monodispersed silver iodobromide emulsion (AgI 6 mol %, mean grain size 0.6μ, fluctuation coefficient on grain size 0.15) | 0.55 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.2 |
| Fourth Layer: Second Red-sensitive Emulsion Layer | |
| Tabular silver iodobromide emulsion (AgI 10 mol %, mean grain size 0.7μ, mean aspect ratio 5.5, mean thickness 0.2μ) | 1.0 as Ag |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Fifth Layer: Third Red-sensitive Emulsion Layer | |
| Silver iodobromide emulsion (AgI 16 mol %, mean grain size 1.1μ) | 1.60 as Ag |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| Sixth Layer: Interlayer | |
| EX-5 | 0.040 |
| HBS-1 | 0.020 |
| Gelatin | 0.80 |
| Seventh Layer: First Green-sensitive Emulsion Layer | |
| Tabular silver iodobromide emulsion (AgI 6 mol %, mean grain size 0.6μ, mean aspect ratio 6.0, mean thickness 0.15μ) | 0.40 as Ag |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Eighth Layer: Second Green-sensitive Emulsion Layer | |
| Monodispersed silver iodobromide emulsion (AgI 9 mol %, mean grain size 0.7μ, fluctuation coefficient on grain size 0.18) | 0.80 as Ag |
| Sensitizing Dye V | $2.1 \times 10^{-5}$ |
| Sensitizing Dye VI | $7.0 \times 10^{-5}$ |

-continued

| | |
|---|---|
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Ninth Layer: Third Green-sensitive Emulsion Layer | |
| Silver iodobromide emulsion (AgI 12 mol %, mean grain size 1.0μ) | 1.2 as Ag |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Tenth Layer: Yellow Filter Layer | |
| Yellow colloidal silver | 0.05 as Ag |
| EX-5 | 0.08 |
| HBS-2 | 0.03 |
| Gelatin | 0.95 |
| Eleventh Layer: First Blue-sensitive Emulsion Layer | |
| Tabular silver iodobromide emulsion (AgI 6 mol %, mean grain size 0.6μ, mean aspect ratio 5.7, mean thickness 0.15μ) | 0.24 as Ag |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |

-continued

| | |
|---|---|
| Twelfth Layer: Second Blue-sensitive Emulsion Layer | |
| Monodispersed silver iodobromide emulsion (AgI 10 mol %, mean grain size 0.8μ, fluctuation coefficient on grain size 0.16) | 0.45 as Ag |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer: Third Blue-sensitive Emulsion Layer | |
| Silver iodobromide emulsion (AgI 14 mol %, mean grain size 1.3μ) | 0.77 as Ag |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Silver iodobromide emulsion (AgI 1 mol %, mean grain size 0.07μ) | 0.5 as Ag |
| U-4 | 0.11 |
| U-5 | 0.17 |
| HBS-1 | 0.90 |
| Gelatin | 1.00 |
| Fifteenth Layer: Second Protective Layer | |
| Polymethyl acrylate grains (diameter about 1.5 μm) | 0.54 |
| S-1 | 0.15 |
| S-2 | 0.05 |
| Gelatin | 0.72 |

A gelatin-hardening agent (H-1) and a surfactant were added to each layer, in addition to the above-mentioned components.

The compounds used in the layers were as follows.

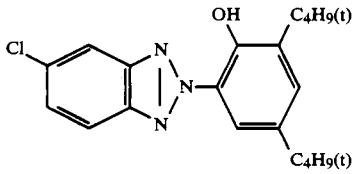

U-1

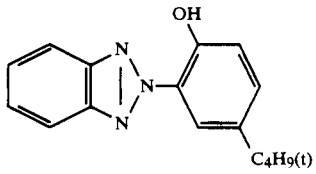

U-2

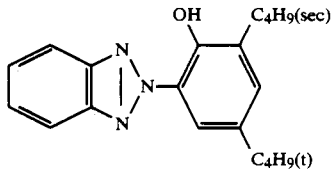

U-3

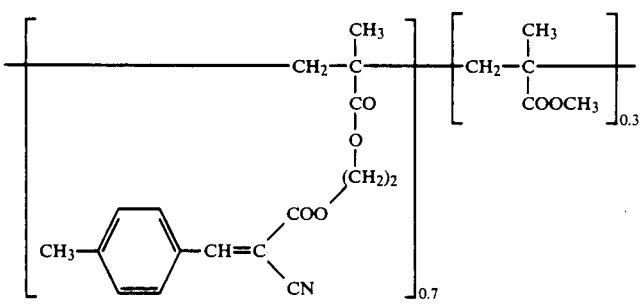

U-4

-continued
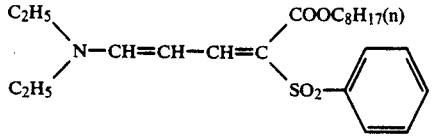
U-5
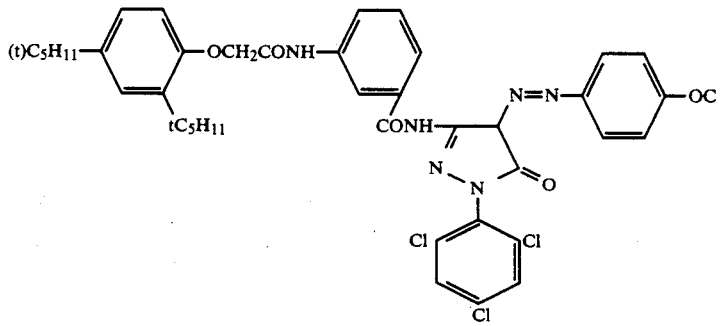
EX-1
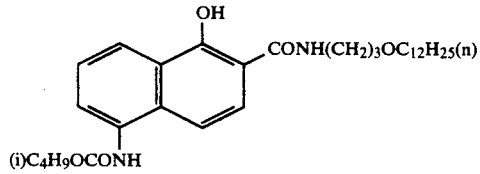
EX-2
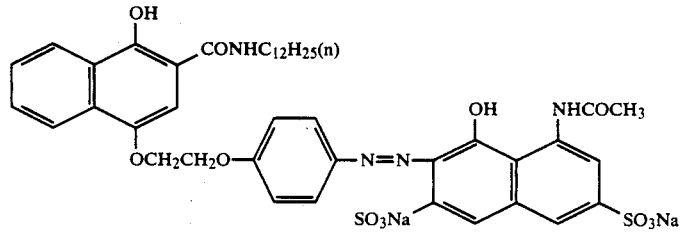
EX-3
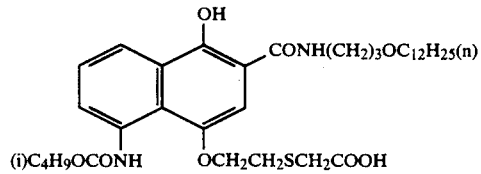
EX-4
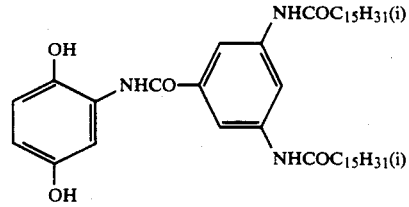
EX-5

-continued
EX-6
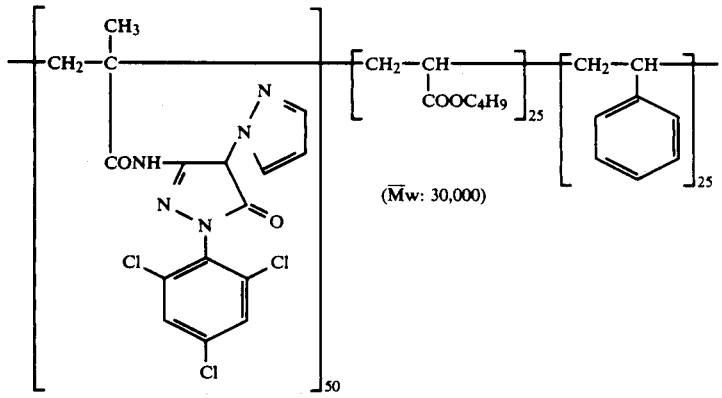
EX-7
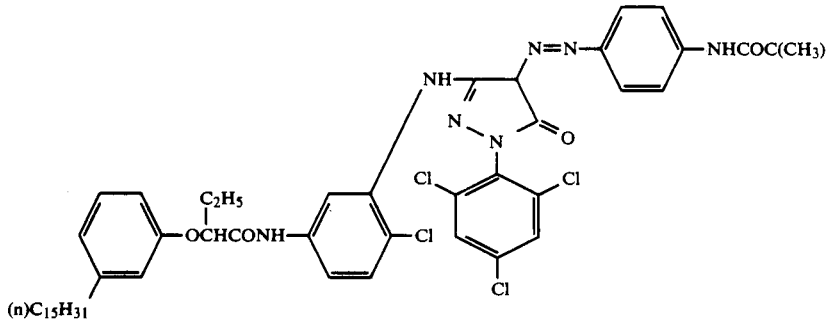
EX-8
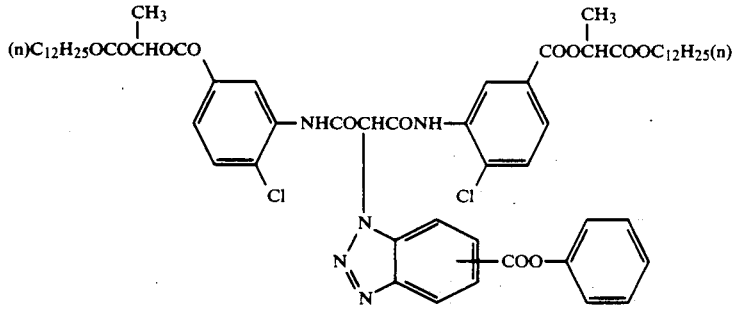
EX-9
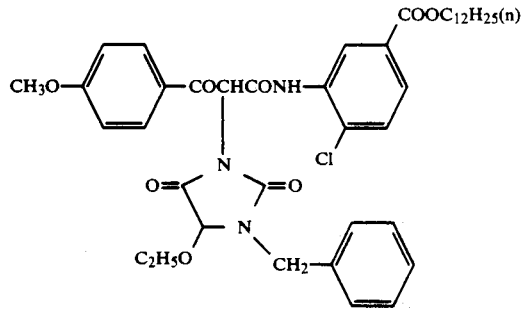

-continued
EX-10
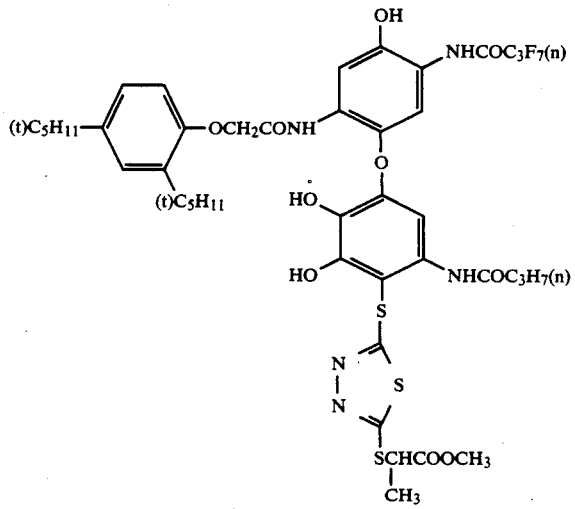
EX-11
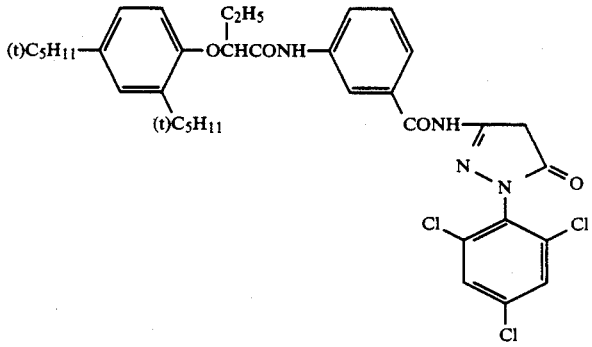
EX-12
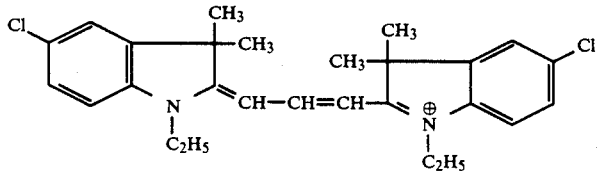
S-1
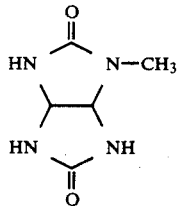
S-2
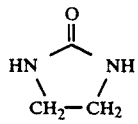
Tricresyl phosphate HBS-1
Dibutyl phthalate HBS-2
Bis(2-ethylhexyl)phthalate HBS-3
HBS-4
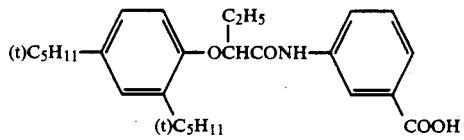

-continued
$CH_2{=}CH{-}SO_2{-}CH_2CONH{-}CH_2$
$CH_2{=}CH{-}SO_2{-}CH_2{-}CONH{-}CH_2$ H-1
Sensitizing Dyes:
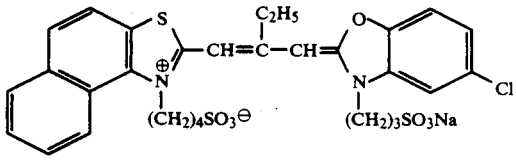
I
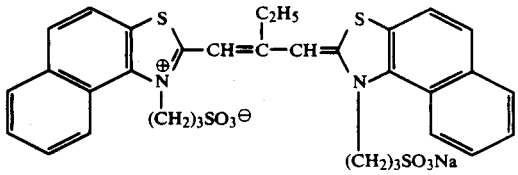
II
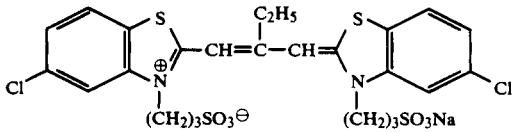
III
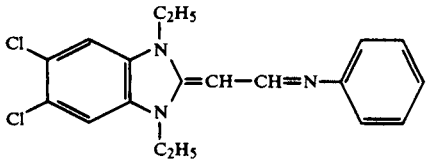
IV
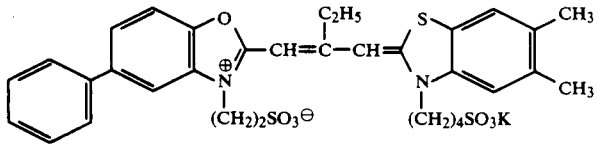
V
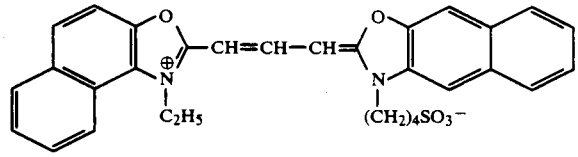
VI
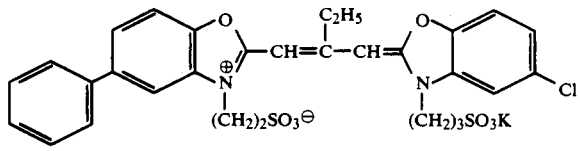
VII
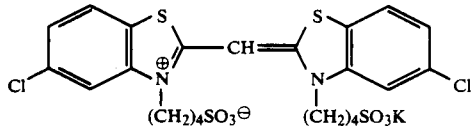
VIII -continued

IX

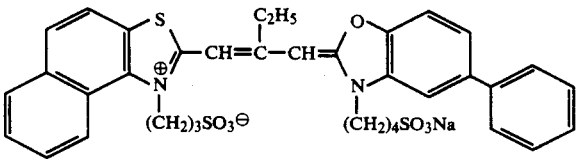

Preparation of Sample Nos. 502 to 504

Sample Nos. 502 to 504 were prepared in the same manner as Sample No. 501, except that EX-5 in the sixth layer of Sample No. 501 was replaced by the same weight of Comparative Compounds (A), (B) and (C), respectively.

Preparation of Sample Nos. 505 to 508

Sample Nos. 505 to 508 were prepared in the same manner as Sample No. 501, except that EX-5 in the sixth layer of Sample No. 501 was replaced by the same weight of polymers Nos. 2, 4, 9 and 22 of the invention, respectively.

The thus prepared samples were imagewise exposed in red and then processed for color development in accordance with the procedure mentioned below.

The magenta color density of each of the thus developed samples was measured with a green filter. The difference (D-1) between the magenta density by the exposure of giving the maximum cyan color density and the magenta density by the exposure of giving the minimum cyan color density was calculated and the degree of the mixing of the cyan color part into the magenta part was obtained, and the results are shown in Table 10 below.

Processing Steps

| Step | Time | Processing Steps: Processing Temperature | Amount of Replenisher | Tank Capacity |
|---|---|---|---|---|
| Color Development | 2 min 30 sec | 40° C. | 10 ml | 8 liters |
| Bleach-Fixation | 3 min 00 sec | 40° C. | 20 ml | 8 liters |
| Rinsing (1) | 20 sec | 35° C. | (counter-current system from (2) to (1)) | 2 liters |
| Rinsing (2) | 20 sec | 35° C. | 10 ml | 2 liters |
| Stabilization | 20 sec | 35° C. | 10 ml | 2 liters |
| Drying | 50 sec | 65° C. | | |

The amount of the replenisher shown above is based on the sample (35 mm width × 1 m length) processed.

Next, the compositions of the processing solutions used are mentioned below.

Color Developer

| | Mother Solution (g) | Replenisher (g) |
|---|---|---|
| Ethylenediaminepenta-acetic acid | 2.0 | 2.2 |
| 1-Hydroxyethylidene-1,1-diphosphonic acid | 3.0 | 3.2 |

-continued

| | Mother Solution (g) | Replenisher (g) |
|---|---|---|
| Sodium sulfite | 4.0 | 5.5 |
| Potassium carbonate | 30.0 | 45.0 |
| Potassium bromide | 1.4 | |
| Potassium iodide | 1.5 mg | |
| Hydroxylamine sulfate | 2.4 | 3.0 |
| 4-(N-Ethyl-N-(8-hydroxy-ethyl)amino)-2-methyl-aniline sulfate | 4.5 | 7.5 |
| Water to make | 1.0 l | 1.0 l |
| pH | 10.05 | 10.20 |

Bleach-fixing Solution: (Mother solution and replenisher were same.)

| | |
|---|---|
| Ethylenediaminetetraacetic acid ferric ammonium complex dihydrate | 50.0 g |
| Ethylenediaminetetraacetic acid disodium salt | 5.0 g |
| Sodium sulfite | 12.0 g |
| Ammonium thiosulfate (70 wt % aqueous solution) | 260.0 ml |
| Acetic acid (98 wt %) | 5.0 ml |
| Bleaching accelerator | 0.01 mol |

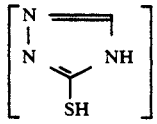

| | |
|---|---|
| Water to make | 1.0 l |
| pH | 6.0 |

Rinsing Solution: (Mother solution and replenisher were same.)

A tap water was passed through a mixed bed column filled with an H-type strong acid cation exchange resin (Amberlite® IR-120B, manufactured by Rohm & Haas Co.) and an OH-type anion exchange resin (Amberlite® IR-400, manufactured by Rohm & Haas Co.) so that the calcium ion concentration and the magnesium ion concentration were both reduced to 3 mg/liter or less, and then 20 mg/liter of sodium dichloroisocyanurate and 1.5 g/liter of sodium sulfate were added thereto.

The resulting solution had a pH value of from 6.5 to 7.5.

Stabilizing Solution: (Mother solution and replenisher were same.)

| | |
|---|---|
| Formalin (37 wt %) | 2.0 ml |
| Polyoxyethylene-p-monononylphenylether (mean polymerization degree 10) | 0.3 g |
| Ethylenediamine-tetraacetic acid disodium salt | 0.05 g |

-continued

| | |
|---|---|
| Water to make | 1.0 l |
| pH | 5.0 to 8.0 |

TABLE 10

| Sample | Compound | D-1 |
|---|---|---|
| 501 (Comparison) | EX-5 | 0.11 |
| 502 (") | Comparative Compound (A) | 0.18 |
| 503 (") | Comparative Compound (B) | 0.17 |
| 504 (") | Comparative Compound (C) | 0.13 |
| 505 (The Invention) | Polymer No. 2 | 0.09 |
| 506 (") | Polymer No. 4 | 0.07 |
| 507 (") | Polymer No. 9 | 0.09 |
| 508 (") | Polymer No. 22 | 0.06 |

The results in Table 10 above indicate that the amount of color mixing was less in Sample Nos. 505 to of the present invention than in comparative Sample Nos. 501 to 504.

EXAMPLE 6

Preparation of Sample Nos. 601 to 604

Sample Nos. 601 to 604 were prepared in the same manner as Sample No..101 of Example 1, except that Cpd-1 in the fifth layer of Sample No. 101 was replaced by the same weight of the polymers Nos. 27, 31, 35 and 42 of the present invention, respectively.

The thus prepared samples were imagewise exposed in red and then processed for color development in accordance with the same procedure as in Example 1.

The thus developed samples were evaluated in the same manner as in Example 1. The results are shown in Table 11 below.

TABLE 11

| Sample | Compound | D-1 | D-2 |
|---|---|---|---|
| 101 | Cpd-1 | 0.12 | 3.33 |
| 102 | Comparative Compound (A) | 0.18 | 3.36 |
| 103 | Comparative Compound (B) | 0.17 | 3.42 |
| 104 | Comparative Compound (C) | 0.13 | 3.17 |
| 601 | Polymer No. 27 | 0.08 | 3.36 |
| 602 | Polymer No. 31 | 0.10 | 3.34 |
| 603 | Polymer No. 35 | 0.09 | 3.38 |
| 604 | Polymer No. 42 | 0.11 | 3.33 |

(Example 1 is referred, for the results of Sample Nos. 101 to 104.)

The smaller value of (D-1) means that the color stain in the processed sample was less. Accordingly, it can be understood .that the polymers of the present invention have better color stain-preventing action. In the samples containing a polymer of the present invention, the value of (D-2) was comparatively large, and accordingly, it can be also understood that the samples of the present invention are excellent in storage stability.

EXAMPLE 7

In the same manner as in Example 2, light-sensitive sheets (E) and (F) were prepared.

Light-sensitive Sheet (E): This was same as the sheet (A), except that the color stain-preventing agent in the layer (6) of the sheet (A) was replaced by the same weight of polymer No. 29 of the invention.

Light-sensitive Sheet (F): This was same as the sheet (A), except that the color stain-preventing agent in the layer (6) of the sheet (A) was replaced by the same weight of polymer No. 37 of the invention.

In addition, the same cover sheet as in Example was prepared.

The thus prepared light-sensitive sheets (E) and (F) and the light-sensitive sheets (C) and (D) of Example 2 were wedgewise exposed and then combined with a container containing the processing solution of Example 2 and the cover sheet prepared by the manner of Example 2. The thus combined sheets were pressed with a pressing member at a temperature of 25° C. or 35° C. so that the processing solution was spread in a thickness of 80 μ between the sheets to obtain a transferred color image. The transferred image was measured with a color densitometer to obtain Dg (green filter density) and Db (blue filter density). The value of Db when Dg=2.0 was shown in Table 12 below.

TABLE 12

| | Processing Temperature 35° C. | | | Processing Temperature 25° C. | | |
|---|---|---|---|---|---|---|
| | Dg | Db | Difference in Db from Sheet (D) | Dg | Db | Difference in Db from Sheet (D) |
| Light-sensitive Sheet (E) (The Invention) | 2.00 | 0.41 | 0.07 | 2.00 | 0.39 | 0.06 |
| Light-sensitive Sheet (F) (The Invention) | 2.00 | 0.44 | 0.10 | 2.00 | 0.42 | 0.09 |
| Light-sensitive Sheet (C) (Comparison) | 2.00 | 0.53 | 0.19 | 2.00 | 0.49 | 0.16 |
| Light-sensitive Sheet (D) (*) | 2.00 | 0.34 | — | 2.00 | 0.33 | — |

(*) Value when no color turbidity appeared.

In the light-sensitive sheets (C) to (F), the color stain-preventing agent-containing layer (6) was coated in order that, when the oxidation product of the developing agent as formed in the green-sensitive silver halide emulsion-containing layer (5) is diffused to the yellow dye-releasing redox compound-containing layer (7), which was not adjacent to the silver halide emulsion layer (5), through the layer (6), the oxidation product of the developing agent could not react with the yellow-dye-releasing redox compound to release an yellow dye (whereby the magenta color turbidity caused by introduction of yellow into magenta to worsen the magenta hue could be prevented). Accordingly, the capacity of the color stain-preventing agent-containing layer (6) in these light-sensitive sheets (E) and (F) may be evaluated from the difference of the respective value Db from that of the sheet (D), which means the color turbidity. The light-sensitive sheets (E) and (F) containing a polymer of the present invention have an extremely lower color turbidity value than the comparative sheets (C) and (D), and thus it is apparent that the former two have a higher color stain preventing capacity than the latter two.

EXAMPLE 8

Preparation of Sample Nos. 801 to 803

Sample Nos. 801 to 803 were prepared in the same manner as Sample No. 301 of Example 3, except that the color mixing preventing agent (Cpd-3) in the second layer of Sample No. 301 was replaced by the same weight of the polymer Nos. 26, 30 and 45 of the present invention, respectively.

The thus prepared samples were imagewise exposed in blue and then processed for color development in accordance with the same procedure as in Example 3. The thus developed samples were evaluated in the same manner as in Example 3, and the results obtained are shown in Table 13 below.

TABLE 13

| Sample | Compound | Color Mixing |
|---|---|---|
| 301 | Cpd-3 | 0.11 |
| 302 | Comparative Compound (A) | 0.12 |
| 303 | Comparative Compound (B) | 0.11 |
| 801 | Polymer No. 26 | 0.06 |
| 802 | Polymer No. 30 | 0.08 |
| 803 | Polymer No. 45 | 0.09 |

(Example 3 was referred to, for the results of Sample Nos. 301 to 303.)

The results of Table 13 indicate that the color mixing was less in Sample Nos. 801 to 803 of the present invention than in comparative Sample Nos. 301 to 303.

EXAMPLE 9

Preparation of Sample Nos. 901 to 904

Sample Nos. 901 to 904 were prepared in the same manner as Sample No. 401 of Example 4, except that the compound (Cpd-1) in the sixth layer of Sample No. 401 was replaced by the same weight of polymer Nos. 29, 33, 38 and of the present invention, respectively.

After the same running treatment as in Example 4, Sample Nos. 901 to 904 were imagewise exposed in red and then processed for color development in accordance with the same reversal procedure as in Example 4. The thus developed samples were evaluated in the same manner as in Example 4. The results obtained are shown in Tabel 14.

TABLE 14

| Sample | Compound | D-1 | D-2 | Y Dmax | M Dmax |
|---|---|---|---|---|---|
| 401 | Cpd-1 | 2.91 | 0.36 | 3.01 | 3.03 |
| 402 | Comparative Compound (B) | 2.85 | 0.42 | 3.02 | 2.96 |
| 403 | Comparative Compound (C) | 2.88 | 0.35 | 3.05 | 2.99 |
| 901 | Polymer No. 29 | 2.89 | 0.31 | 3.03 | 2.97 |
| 902 | Polymer No. 33 | 2.87 | 0.26 | 3.02 | 2.98 |
| 903 | Polymer No. 38 | 2.90 | 0.27 | 3.04 | 2.96 |
| 904 | Polymer No. 41 | 2.92 | 0.30 | 3.04 | 2.97 |

(Example 4 was referred to, for the results of Sample Nos. 401 to 403.)

It is noted from the results shown in Table 14 that Sample Nos. 901 to 904 of the present invention had a lower minimum cyan color density (D-2) than the comparative Sample Nos. 401 to 403. Accordingly, it can be understood that the polymers of the present invention are more effective color stain prevention agents and moreover, do not exert an adverse effect on the coloration of other layers.

EXAMPLE 10

Preparation of Sample Nos. 1001 to 1004

Sample Nos. I001 to 1004 were prepared in the same manner as Sample No. 501 of Example 5, except that EX-5 in the sixth layer of Sample No. 501 was replaced by polymer Nos. 28, 34, 39 and 42 of the present invention, respectively.

These samples were imagewise exposed in red and then processed for color development in accordance with the same procedure as in Example 5. The thus developed samples were evaluated in the same manner as in Example 5. The results obtained are shown in Table 15 below.

TABLE 15

| Sample | Compound | D-1 |
|---|---|---|
| 501 | EX-5 | 0.11 |
| 501 | Comparative Compound (A) | 0.18 |
| 503 | Comparative Compound (B) | 0.17 |
| 504 | Comparative Compound (C) | 0.13 |
| 1001 | Polymer No. 28 | 0.08 |
| 1002 | Polymer No. 34 | 0.07 |
| 1003 | Polymer No. 39 | 0.10 |
| 1004 | Polymer No. 42 | 0.08 |

(Example 5 was referred to, for the results of Sample Nos. 501 to 504.)

The results of Table 15 indicate that degree of the color mixing was less in Sample Nos. 1001 to 1004 of the present invention than in comparative Sample Nos. 501 to 504.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one polymer obtained by the polycondensation of at least one compound selected from the group consisting of the formulae (III), (IV), (V), and (VI) and at least one compound represented by formula (II):

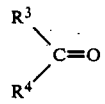

(II)

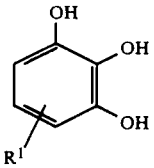

(III)

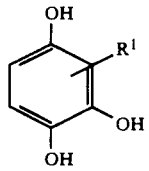

(IV)

-continued (V)

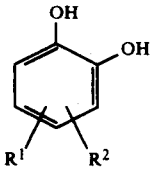

(VI)

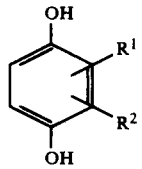

wherein $R^1$ and $R^2$ each represent a hydrogen atom or a substituent; and $R^3$ and $R^4$ each represents a hydrogen atom, an alkyl group, an aryl group, an aralkyl group, a heterocyclic group, an acyl group, a carboxyl group, or a formyl group, in the presence of an acid or alkali catalyst and wherein said polymer obtained by said polycondensation has a mean molecular weight of from 2,000 to 20,000 when said polymer does not contain a long chain alkyl moiety having 6 or more carbon atoms, and wherein said polymer obtained by said polycondensation product has a mean molecular weight of from 1,000 to 8,000 when said polymer contains a long chain alkyl moiety having 6 or more carbon atoms.

2. A silver halide photographic material as in claim 1, wherein said polymer is added to one or more silver halide emulsion layers and/or one or more non-light-sensitive layers.

3. A silver halide photographic material as in claim 2, wherein said polymer is added to one or more silver halide emulsion layers as a color mixing preventing agent in an amount of from $1\times10^{-6}$ to $1\times10^{-3}$ mol/m$^2$ as the unit derived from the compound represented by the group consisting of the formulae (III), (IV), (V) and (VI).

4. A silver halide photographic material as in claim 2, wherein the polymer is added to one or more non-light-sensitive layers as a color fogging preventing agent in an amount of from $1\times10^{-7}$ to $1\times10^{-4}$ to mol/m$^2$ as the unit derived from the compound represent by the group consisting of the formulae (III), (IV), (V) and (V).

5. A silver halide photographic material as in claim 3, wherein said amount of said polymer is from $10^{-5}$ to $10^{-3}$ mol/m$^2$.

6. A silver halide photographic material as in claim 4, wherein said amount of said polymer is from $1\times10^{-6}$ to $1\times10^{-4}$ mol/m$^2$.

* * * * *